US008327657B2

(12) United States Patent
Min et al.

(10) Patent No.: US 8,327,657 B2
(45) Date of Patent: Dec. 11, 2012

(54) REFRIGERATOR

(75) Inventors: Deul Re Min, Seoul (KR); Eun Jeong Kim, Changwon-si (KR); Jong Min Shin, Busan (KR); Seok Min Lim, Jinju-si (KR); Yeon Yi Hwang, Busan (KR)

(73) Assignee: LG Electronics Inc., Seoul (KR)

( * ) Notice: Subject to any disclaimer, the term of this patent is extended or adjusted under 35 U.S.C. 154(b) by 546 days.

(21) Appl. No.: 12/091,919

(22) PCT Filed: Oct. 27, 2006

(86) PCT No.: PCT/KR2006/004414
§ 371 (c)(1),
(2), (4) Date: Mar. 5, 2010

(87) PCT Pub. No.: WO2007/049935
PCT Pub. Date: May 3, 2007

(65) Prior Publication Data

US 2010/0170278 A1 Jul. 8, 2010

(30) Foreign Application Priority Data

Oct. 27, 2005 (KR) ..... 10-2005-0101820
Oct. 27, 2005 (KR) ..... 10-2005-0101824
Jan. 25, 2006 (KR) ..... 10-2006-0007709

(51) Int. Cl.
*F25D 23/00* (2006.01)

(52) U.S. Cl. ..... 62/264; 62/240

(58) Field of Classification Search ..... 62/264, 62/440, 131, 78, 77; 99/451, 468; 426/248; 315/5.24, 405; 362/133, 609, 612
See application file for complete search history.

(56) References Cited

U.S. PATENT DOCUMENTS

| | | | | |
|---|---|---|---|---|
| 2,135,878 | A | 11/1938 | Sekyra, Sr. | |
| 2,209,869 | A | 7/1940 | Yoxsimer | |
| 4,685,808 | A * | 8/1987 | Nakazawa et al. | 356/416 |
| 5,223,917 | A * | 6/1993 | Richert | 356/407 |
| 5,481,113 | A * | 1/1996 | Dou et al. | 250/341.1 |
| 5,497,207 | A * | 3/1996 | Kim | 353/66 |
| 5,579,921 | A * | 12/1996 | Mallant et al. | 209/580 |
| 6,414,705 | B1 * | 7/2002 | Yamada et al. | 347/232 |
| 6,624,417 | B1 * | 9/2003 | Inada et al. | 250/339.12 |
| 2003/0019222 | A1 * | 1/2003 | Takahashi et al. | 62/131 |
| 2003/0063462 | A1 * | 4/2003 | Shimizu et al. | 362/230 |
| 2004/0066307 | A1 * | 4/2004 | Lin et al. | 340/815.45 |
| 2005/0002191 | A1 * | 1/2005 | Shimizu et al. | 362/237 |

(Continued)

FOREIGN PATENT DOCUMENTS

DE 934 833 11/1955

(Continued)

*Primary Examiner* — Mohammad Ali
(74) *Attorney, Agent, or Firm* — Birch, Stewart, Kolasch & Birch, LLP

(57) ABSTRACT

Disclosed herein is a refrigerator which can store foodstuffs like vegetables in a fresh state, restrain reduction of nutritive elements contained in foodstuffs, and prevent damage of irradiation device. The refrigerator includes a main body, a storage chamber which is provided in the main body to store foodstuffs, and an irradiation device which irradiates light within a visible light region into the storage chamber. The refrigerator farther includes a reflection member which is mounted to the storage chamber to reflect the light emitted from the irradiation device, and a transforming member which transforms the light emitted from the irradiation device into a side light type.

37 Claims, 18 Drawing Sheets

U.S. PATENT DOCUMENTS

| | | | | |
|---|---|---|---|---|
| 2005/0128759 | A1* | 6/2005 | Fredericks et al. | 362/470 |
| 2005/0279949 | A1* | 12/2005 | Oldham et al. | 250/458.1 |
| 2007/0104841 | A1 | 5/2007 | Min et al. | |

FOREIGN PATENT DOCUMENTS

| | | | |
|---|---|---|---|
| DE | 44 04 247 | A1 | 8/1995 |
| DE | 297 15 157 | U1 | 2/1998 |
| JP | 07-098176 | A | 4/1995 |
| JP | 09-028363 | A | 2/1997 |
| JP | 11-159953 | A | 6/1999 |
| JP | 2000-258051 | A | 9/2000 |
| JP | 2005-049093 | A | 2/2005 |
| JP | 2005-65622 | A | 3/2005 |
| KR | 1996-0024185 | A | 7/1996 |
| KR | 1998-0003428 | A | 3/1998 |
| KR | 1999-007064 | U | 2/1999 |
| KR | 2002-0066565 | A | 8/2002 |
| KR | 10-2007-004943 | A | 5/2007 |
| NL | 1022656 | C2 | 8/2004 |

* cited by examiner

REFRIGERATOR

TECHNICAL FIELD

The present invention relates to a refrigerator, and more particularly to a refrigerator which can store foodstuffs like vegetables in a fresh state, restrain reduction of nutritive elements contained in foodstuffs, and prevent damage of irradiation device.

BACKGROUND ART

Generally, a refrigerator comprises a freezing chamber and a cooling chamber. A vegetable compartment is additionally provided at a specific location in the cooling chamber so as to store vegetables and fruits in a more fresh state.

Many factors, such as temperature, humidity, environmental gas, microbe, light and etc., do influence on freshness of vegetables. Because vegetables do breathing and transpiration continuously, it is necessary to restrain the breathing and the transpiration in order to maintain the freshness of vegetables. Most vegetables, except for some kinds of vegetables that have trouble at low temperature, restrain the breathing at low temperature and the transpiration at high humidity.

For this reason, the refrigerator is provided with the vegetable compartment with an independent space from the cooling chamber, so as to store vegetables in a fresh state for a long period. The vegetable compartment is kept in adequately low temperature and as high humidity as possible. In other words, the temperature and the humidity in the vegetable compartment are maintained adequately for keeping the freshness of vegetables in the vegetable compartment high.

Meanwhile, research of a method of maintaining the freshness of vegetables by using the light (another influential factor concerning the freshness of vegetables) is being pursued. Relatively strong light has a bad influence of promoting color change and transpiration of vegetables, and relatively weak light has an effect of improving the maintenance of the freshness of vegetables. Also, weak light restrains chlorophyll degradation of green leafy and stem vegetables, and has an effect of keeping in vitamin C.

A conventional refrigerator having a vegetable compartment using light will now be described with reference to FIG. 1.

The conventional refrigerator illustrated in FIG. 1 is a refrigerator disclosed in Japanese Patent Laid-open Publication No. 9-28363. A refrigerator 10A is provided with an irradiation device 23A which irradiates weak light to a vegetable box 20A, so as to prevent decrease of chlorophyll concentration of green leafy and stem vegetables, and resultantly prevent deterioration of the quality of leafy and stem vegetables.

An illuminating lamp 29A is provided over the vegetable box 20A. When the vegetable box 20A is opened, the illuminating lamp 29A emits light to allow a user to easily see the vegetables stored in the vegetable box 20A. When the vegetable box 20A is closed, the irradiation device 23A irradiates weak light to the vegetable box 20A to prevent deterioration of quality of green leafy and stem vegetables.

Japanese Patent Laid-open Publication No. 11-159953 discloses a refrigerator provided with the irradiation device 23A which is embodied by a light emitting diode (LED) which emits light within a visible light region. Accordingly, heat generation from the irradiation device 23A is minimized, rise of temperature in a storage space 21A of the vegetable box 20A is prevented, and irradiating efficiency is increased as compared to other irradiation devices.

Japanese Patent Laid-open Publication No. 2005-49093 discloses a refrigerator provided with a red LED which emits light of a wavelength of about 660 nm to green leafy and stem vegetables.

Japanese Patent Laid-open Publication No. 2005-65622 discloses a refrigerator provided with several partitioned vegetable compartments and irradiation devices which irradiate light of adequate wavelengths for kinds of vegetables stored in the vegetable compartments. More particularly, a red LED, a blue LED and a green LED are used for selectively combining emitting colors according to the kinds of vegetables.

FIG. 2 shows the irradiation device provided at the vegetable compartment in the conventional refrigerator.

As shown in FIG. 2, an irradiation device 1 of the conventional refrigerator (which is disclosed in Japanese Patent Laid-open Publication No. 11-159953) is embodied by an LED which emits weak light within a visible light region, thereby preventing deterioration of quality of green leafy and stem vegetables.

However, the above conventional refrigerator has problems as follows.

While the vegetable compartment generally has a hexahedral storage space, light emitted from the light source (especially, the LED) goes straight with a constant irradiation angle. Therefore, light emitted from the light source cannot be irradiated to some inner portions of the vegetable compartment, especially, by an irradiating distance and obstacles. In other words, the conventional refrigerator has a shortcoming that light emitted from the light source cannot be effectively irradiated to all vegetables.

Also, light emitted from the light source is not entirely used for keeping the freshness of vegetables. This is because the vegetable box is generally made of transparent or white material, through which the irradiated light can mostly penetrate.

Also, because the irradiation device is mounted in the state of protruding toward the vegetable compartment, the irradiation device may be broken when moving the vegetable box or food storage containers.

Also, a short may occur by damage of an electronic substrate of the irradiation device due to moisture of the refrigerator.

Also, the emitting colors from the three color (red, blue, green) LEDs can be selectively combined, but it is not accurate that which of the red LED, the blue LED and the green LED respectively are effective to which foodstuffs. Therefore, such an irradiation device is not effective to the maintenance of the freshness of the stored foodstuffs and the prevention of the chlorophyll degradation.

Further, means for selecting the emitting color from the three color LED is provided, but the selecting means is not practical due to lack of accurate information that which emitting color is most adequate for which foodstuffs.

Although it is found that which emitting color is most effective to which foodstuffs by experiments, it is very difficult for the user to remember this information one by one to select the emitting color, or it is very troublesome for the user to search this information before selecting the emitting color.

Also, regarding the foodstuffs, the relationship of which with the emitting color is not experimentally found, the user cannot determine which emitting color is adequate for the foodstuffs and cannot be confident whether the user-selected emitting color is adequate for the foodstuffs or not. Thus, the user comes to distrust the irradiation device.

DISCLOSURE OF INVENTION

Technical Problem

Accordingly, the present invention is directed to a refrigerator that substantially obviates one or more problems due to limitations and disadvantages of the related art.

An object of the present invention devised to solve the problem lies on a refrigerator which can effectively use light emitted from a light source for storing vegetables in a fresh state.

Another object of the present invention devised to solve the problem lies on a refrigerator which can prevent breakage of an irradiation device by an external shock and a short of an electronic substrate by moisture permeation.

A further object of the present invention devised to solve the problem lies on a refrigerator which can elongate a period of maintaining freshness and nutritive elements of foodstuffs.

Yet another object of the present invention devised to solve the problem lies on a refrigerator which can improve convenience in use.

Technical Solution

The object of the present invention can be achieved by providing a refrigerator comprising: a main body; a storage chamber which is provided in the main body to store foodstuffs; and an irradiation device which irradiates light within a visible light region into the storage chamber.

The refrigerator may further comprise a reflection member which is mounted to the storage chamber to reflect the light emitted from the irradiation device, and a transforming member which transforms the light emitted from the irradiation device into a side light type.

Preferably, the storage chamber includes a vegetable compartment for storing vegetables. The storage chamber includes a storage box, and the reflection member is mounted to the storage box.

The transforming member is an optical fiber. The transforming member is formed correspondingly to a shape of an edge of the vegetable compartment. The transforming member is mounted to an inner wall of the vegetable compartment. The transforming member is formed correspondingly to a shape of the vegetable compartment in at least one direction of a depth direction and a width direction of the vegetable compartment.

Also, the irradiation device includes a plurality of light sources for emitting the light in several directions.

The irradiation device is mounted to an inner wall of the vegetable compartment. The irradiation device is protrudingly mounted to the inner wall of the vegetable compartment, and the vegetable box is formed with an opening at a position corresponding to the irradiation device.

Alternatively, the irradiation device is mounted in an inner wall of the vegetable compartment.

Preferably, the vegetable box includes a scattering member which scatters the light emitted from the irradiation device. The vegetable box further includes a reflection plate which reflects the light irradiated into the vegetable box.

Alternatively, the irradiation device is protrudingly mounted to an inner wall of the vegetable compartment, and the vegetable box is formed with an opening at a position corresponding to the irradiation device.

Alternatively, the irradiation device is mounted in an inner wall of the vegetable compartment, and is formed with a scattering member which scatters the light emitted from the irradiation device.

The refrigerator may further comprise: a body which is mounted in the main body, and provided with a storage space and an insertion part; and a light permeation member which seals the insertion part of the body. The irradiation device is mounted in the insertion part of the body.

The insertion part is provided with a reflection plate which reflects the light emitted from the irradiation device toward an inside of the body.

The reflection plate is formed with a plurality of convex portions. The reflection plate is formed in a semispherical shape, and has an opening which opposes the storage chamber. The light permeation member is a diffused reflection light filter or a concave lens. The light permeation member is provided with a sealing member at a side surface thereof.

The irradiation device irradiates the light of different combinations of wavelengths correspondingly to a kind of the foodstuffs stored in the storage chamber.

The irradiation device is disposed at an outer rear portion of the storage chamber.

The irradiation device includes a protective cover, a surface of which is corrosion-treated. The storage chamber and the protective cover are made of light permeable material.

The refrigerator may further comprises a selecting device which has a function of enabling a user to input information of a kind of the foodstuffs stored in the storage chamber, and changing a wavelength of the light emitted from the irradiation device, corresponding to a color of the foodstuffs.

Alternatively, the refrigerator may further comprise a color recognition device which recognizes a color of the foodstuffs stored in the storage chamber, and changes a wavelength of the light emitted from the irradiation device, corresponding to the color of the foodstuffs.

Preferably, the irradiation device includes a plurality of light emitting diodes which emit the light having different wavelengths.

The storage chamber is configured to selectively store meats and vegetables. The irradiation device is configured to irradiate red light to the foodstuffs when the color of the foodstuffs is red. The irradiation device is configured to irradiate green light to the foodstuffs when the color of the foodstuffs is green. At this time, the irradiation device is configured to further irradiate white light.

Alternatively, the irradiation device is configured to irradiate green-white combined light when vegetables are stored in the storage chamber, and to irradiate red-blue combined light when meats are stored in the storage chamber.

Also, the refrigerator is configured to adjust an inner temperature of the storage chamber, corresponding to the kind of the foodstuffs stored in the storage chamber, and the temperature adjustment is performed in cooperation with the change of the combination of the light emitted from the irradiation device.

Advantageous Effects

The refrigerator according to the present invention has the following effects.

Because the light emitted from the light source can be evenly irradiated to the vegetables stored in the vegetable compartment, freshness of the vegetables can be maintained more effectively.

Also, by separately storing the foodstuffs classified by colors and controlling the irradiation device to irradiate the most adequate light for the color of the stored foodstuffs, the effects of maintaining freshness of the foodstuffs and preventing chlorophyll degradation can be maximized.

Further, instead of the user directly selecting the light emitted from the irradiation device, since the user only inputs the information of the kind of the stored foodstuffs or the color recognition device automatically detects the color of the stored foodstuffs, the convenience in use is increased.

Also, because the light emitting elements are insertedly mounted in a refrigerator body, breakage of the light emitting elements due to the collision with the stored foodstuffs can be prevented.

Also, because the light emitted from the light emitting elements are irradiated through the polarized light filter or the concave lens, the light can be more evenly irradiated to the foodstuffs stored in the storage chamber.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
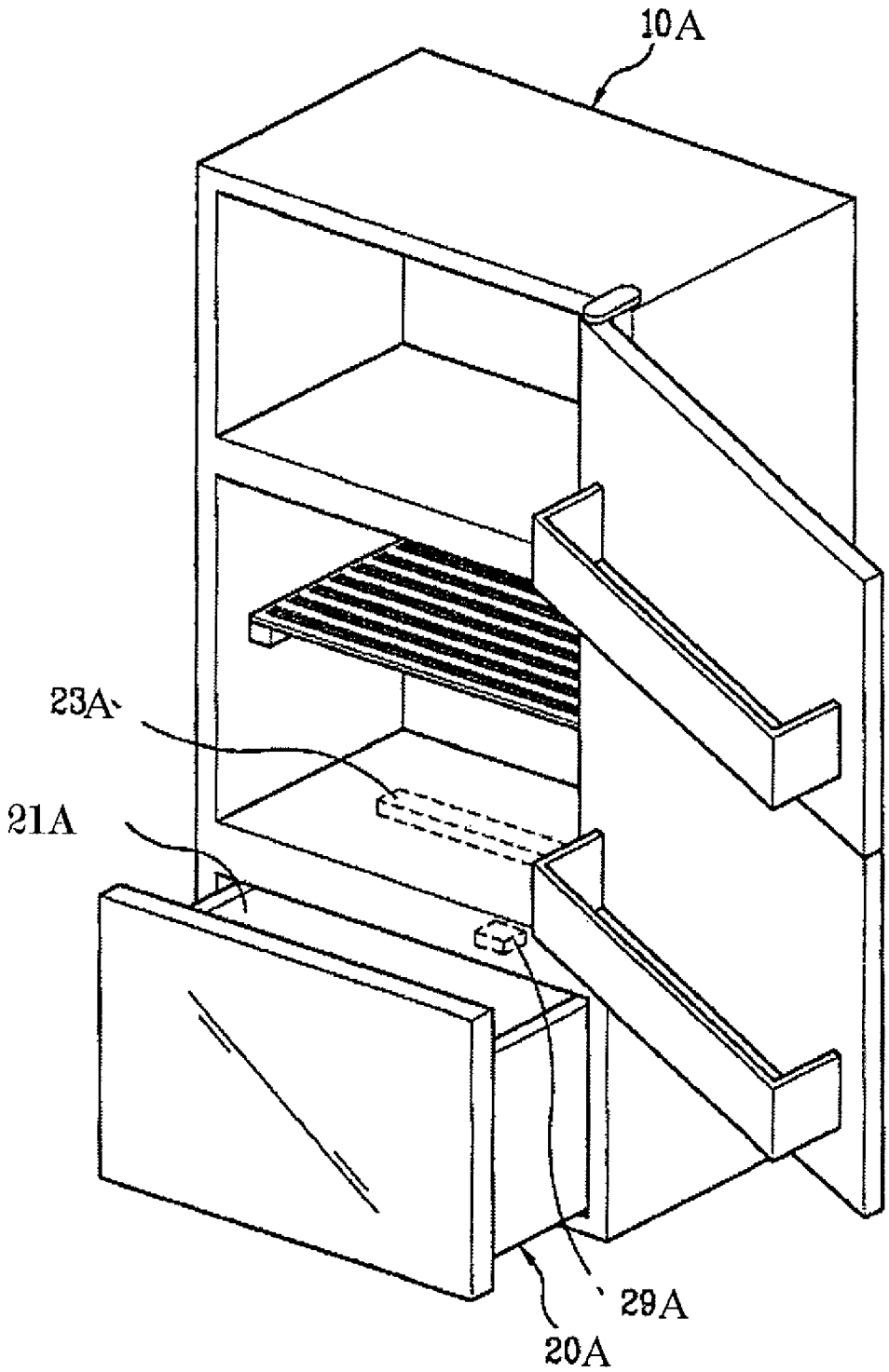
FIGS. 1 and 2 are perspective views showing a conventional refrigerator.
Figure 2:
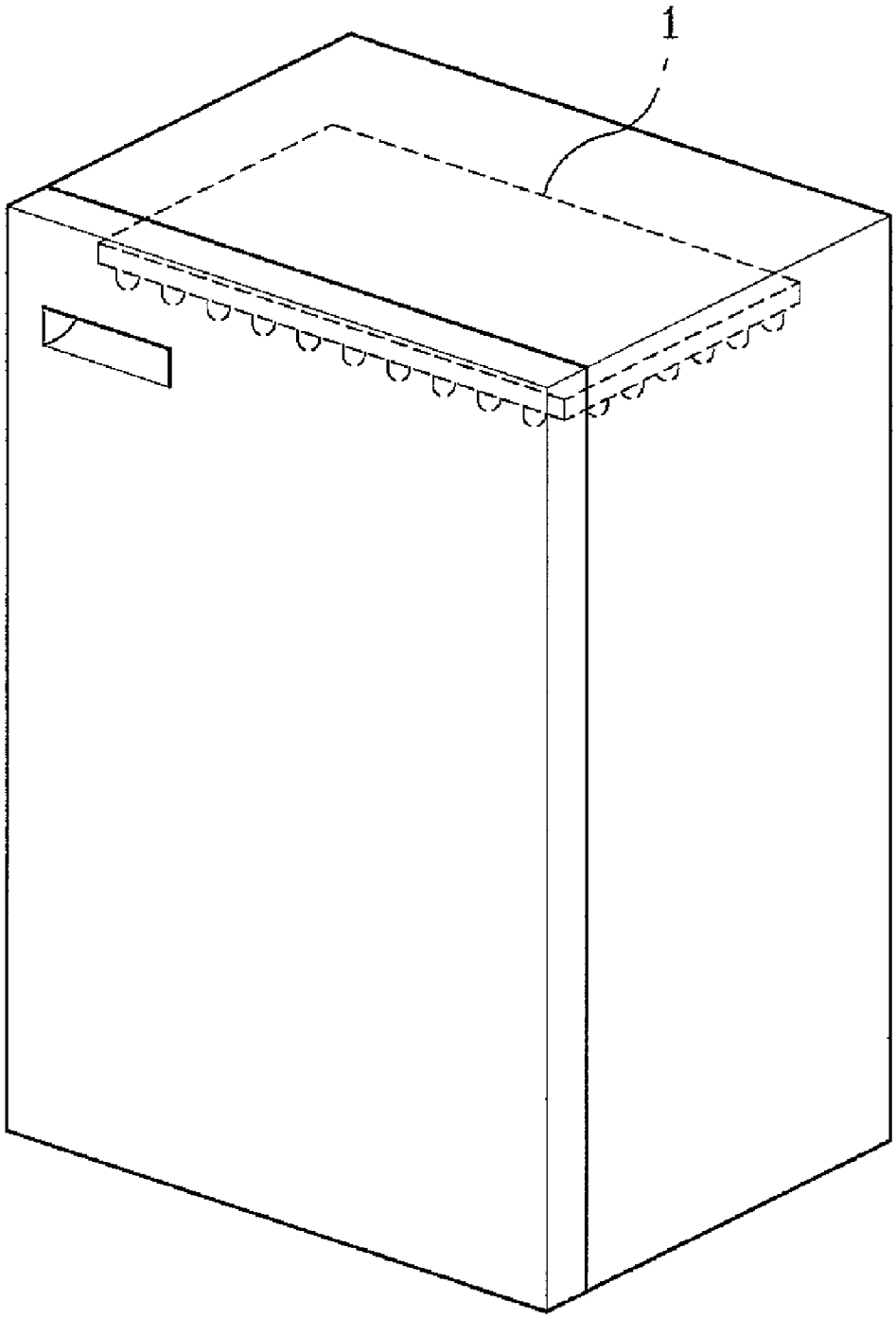
Figure 3:
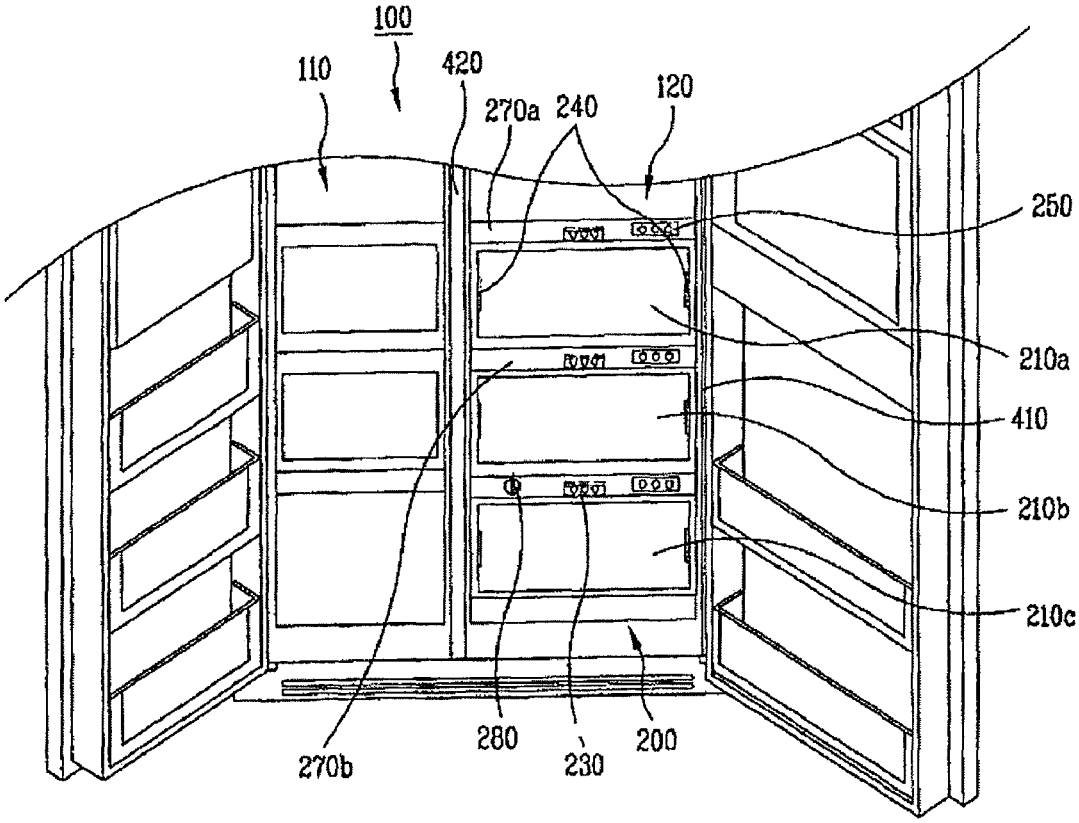
FIG. 3 is a perspective view showing a refrigerator in accordance with the present invention.

A refrigerator according to a preferred embodiment of the present invention will now be described with reference to FIG. 3.

A refrigerator 100 comprises a freezing chamber 110 and a cooling chamber 120. As an example of a storage chamber, a vegetable compartment 200 is additionally provided in the cooling chamber 120. Generally, the vegetable compartment 200 is located at a bottom portion in the cooling chamber 120.

Hereinafter, the vegetable compartment 200 will be described in detail.

The refrigerator may be provided with one or more partitioned vegetable compartments 200. FIG. 3 shows the refrigerator 100 having several vegetable compartments. Vegetable boxes 210*a*, 210*b* and 210*c* are received in the respective vegetable compartments one by one. Preferably, the lowermost vegetable box 210*c* is provided with a temperature adjusting device 280, so as to selectively store meats or vegetables as needed.

For convenience of description, the uppermost vegetable compartment will be described as an example. Since other vegetable compartments have a similar structure to the uppermost vegetable compartment, the description thereof will be omitted.

The cooling chamber 120 is formed with a space for receiving the vegetable box 210*a*. The space is defined by a lower partition wall 270*b*, an upper partition wall 270*a*, left and right partition walls 420 and 410, and a rear partition wall (not shown). The vegetable box 210*a* is disposed in the space. The vegetable box 210*a* can be drawn toward a front of the refrigerator and has an opened upper portion, however, the structure of the vegetable compartment 200 in the present invention is not restricted thereto but can be variously modified.

A light source 230 for irradiating light to the vegetable box 210*a* and a switch 250 for manipulating the light source 230 are mounted to the upper partition wall 270*a*. The light source 230 may be embodied by any light emitting element which can irradiate weak light to vegetables to keep the freshness of the vegetables. In terms of restricting heat generation and decreasing power consumption, it is preferable to use a light emitting diode as the light source.

A reflection member 240 is mounted to a certain position of the vegetable box 210*a*. The reflection member 240 has a function of preventing light emitted from the light source 230 from penetrating through or being absorbed in the vegetable box 210*a*.

Figure 4:
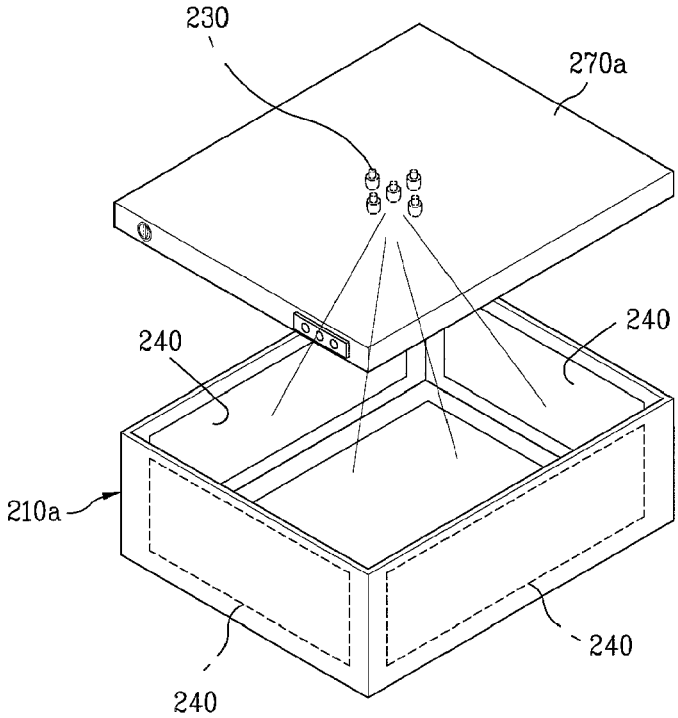
FIG. 4 is a perspective view showing a vegetable compartment of a refrigerator depicted in FIG. 3.

Referring to FIG. 4, the reflection member will now be described in detail.

Based on the features and the mounting position of the light source 230, the mounting position and the number of the reflection member 240 are decided. For example, the reflection members 240 may be mounted to inner walls of the vegetable box 210*a*. The reflection member 240 may be mounted to the vegetable box 210*a* as a separate component, or may be formed integrally with the vegetable box 210*a*.

It is illustrated in FIG. 4 that the reflection member 240 is mounted to the vegetable box 210*a*, however, the present invention is not restricted thereto. That is, the reflection member 240 may be mounted to an inner wall of the space in which the vegetable box 210*a* is received (i.e., the space forming the vegetable compartment). In this case, it is preferable that the vegetable box 210*a* is made of transparent material, through which light penetrates.

Referring to FIGS. 5 to 9, a refrigerator according to another embodiment of the present invention will now be described.

In the previous embodiment, the reflection member is mounted to the vegetable compartment to effectively irradiate light. On the other hand, this embodiment is configured such that the type of light emitted from the light source is transformed into a side light type from an end light type.

Figure 6:
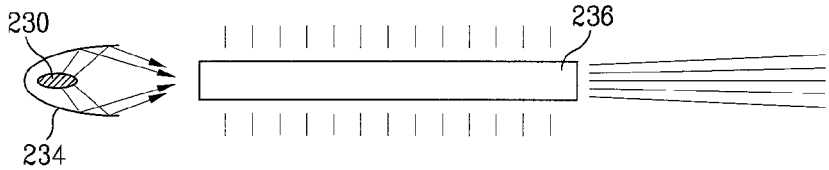
Figure 7:
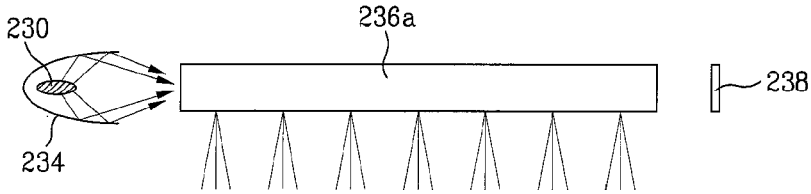

A structure of transforming the light emitted from the light source into the side light type from the end light type will now be described with reference to FIGS. 5 to 7.

Transforming means for transforming the type of light emitted from the light source into another light type is connected to the light source. It is preferable to use an optical fiber as the transforming means, however, the transforming means is not restricted to the optical fiber.

Figure 5:
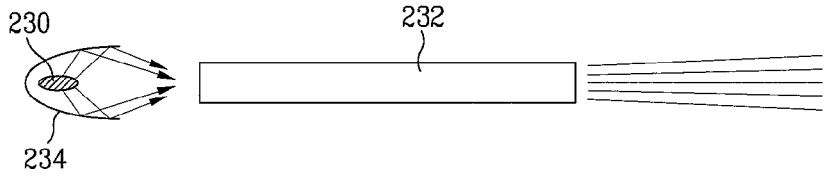
FIGS. 5 to 7 are schematic views showing exemplary modifications of a light source used in a refrigerator in accordance with the present invention.

FIG. 5 shows that light emitted from the light source 230 passes through the transforming means 232 and is irradiated in the end light type from an end of the transforming means 232. FIG. 6 shows that light emitted from the light source 230 passes through the transforming means 236 and is uniformly irradiated in the side light type from opposite side surfaces of the transforming means 236. And, FIG. 7 shows that light emitted from the light source 230 passes through the transforming means 236*a* and is irradiated in the high-illuminance side light type from one side surface of the transforming means 236*a*. The side light or the high-illuminance side light may be used in this embodiment. A non-described reference numeral 234 in FIGS. 5 to 7 refers to a light concentration plate, and 238 refers to a reflection mirror.

Figure 8:
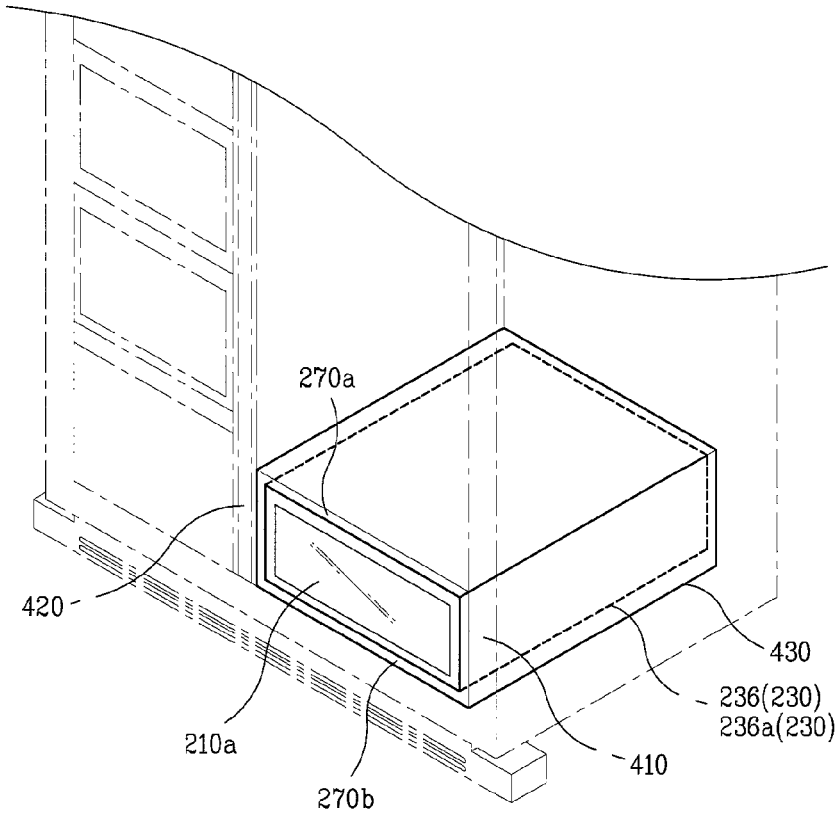
FIGS. 8 and 9 are perspective views showing a refrigerator in accordance with another embodiment of the present invention in which light sources depicted in FIGS. 5 and 7 are used.
Figure 9:
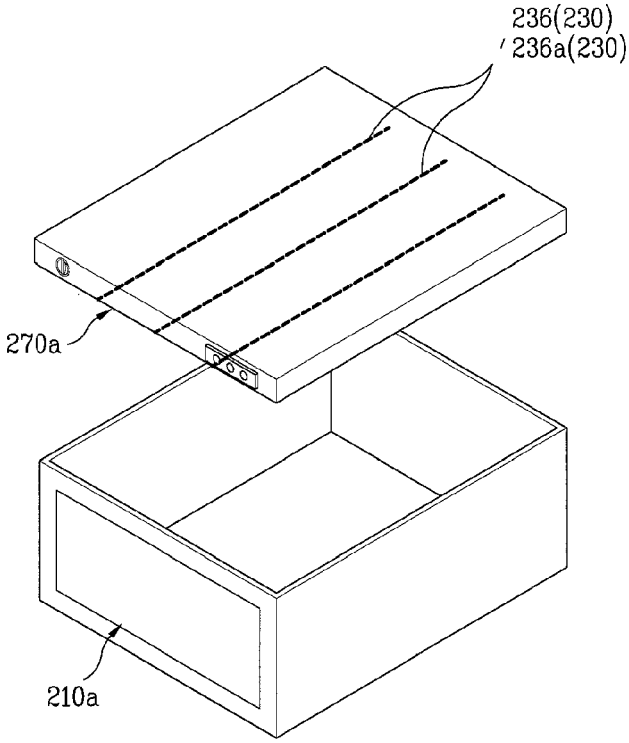

Referring to FIGS. 8 and 9, the embodiments using the side light or the high-illuminance side light will be described in detail.

The light source 230 and the transforming means 236 and 236*a* are mounted together to predetermined positions in the vegetable compartment. It is also possible to dispose the light source 230 at a certain position in the refrigerator and to dispose the transforming means 236 and 236*a* at a certain position in the vegetable compartment independently from the light source.

As shown in FIGS. 8 and 9, the transforming means 236 and 236*a* and the light source 230 are mounted to proper positions in the vegetable compartment. For convenience of description, the installment of only the transforming means 236 and 236*a* will be described hereinafter.

As shown in FIG. 8, the transforming means 236 and 236*a* may be mounted to an edge of the vegetable compartment or the vegetable box 210*a*. Also, as shown in FIG. 9, at least one transforming means 236 and 236*a* may be mounted to the vegetable compartment or the vegetable box 210*a* in a depth direction (a direction from a front portion to a rear portion of the refrigerator). Of course, the transforming means 236 and 236*a* may be mounted to the vegetable compartment or the vegetable box 210*a* in a width direction.

It is more preferable to mount the transforming means 236 and 236*a* to the space in which the vegetable box 210*a* is received, i.e., to the inner wall of the vegetable compartment, rather than to mount the transforming means 236 and 236*a* to the vegetable box 210*a*. This is because the vegetable box 210*a* is generally formed in a drawer type, and the drawer-type vegetable box 210*a* is not convenient to mount the transforming means 236 and 236*a*.

Figure 10:
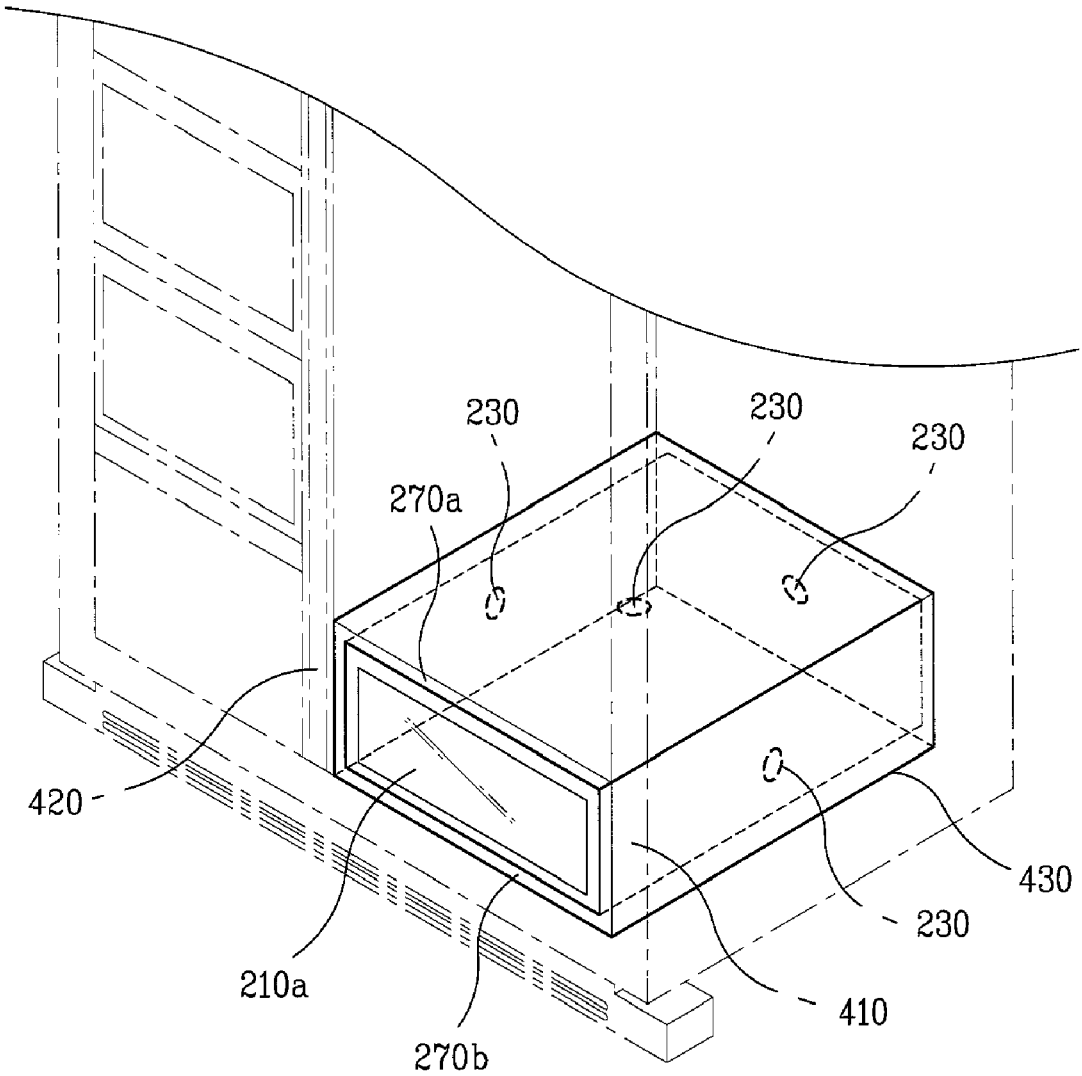
FIG. 10 is a perspective view showing a refrigerator in accordance with a further embodiment of the present invention.

Referring to FIG. 10, a refrigerator according to a further embodiment of the present invention will now be described.

Different from the previous embodiments, this embodiment is configured such that a plurality of light sources 230 are mounted to effectively irradiate light to the vegetable compartment.

Describing in detail, a plurality of light sources 230 are mounted to the predetermined positions of the vegetable compartment. At this time, it is preferable that the light source 230 is a point light source. The mounting positions of the plurality of light sources 230 can be widely decided, however, it is preferable that at least one light source is disposed at an upper plane of the vegetable compartment, and other light sources are disposed at other planes, except the upper plane, e.g., a front plane, side planes and a rear plane of the vegetable compartment.

Figure 11:
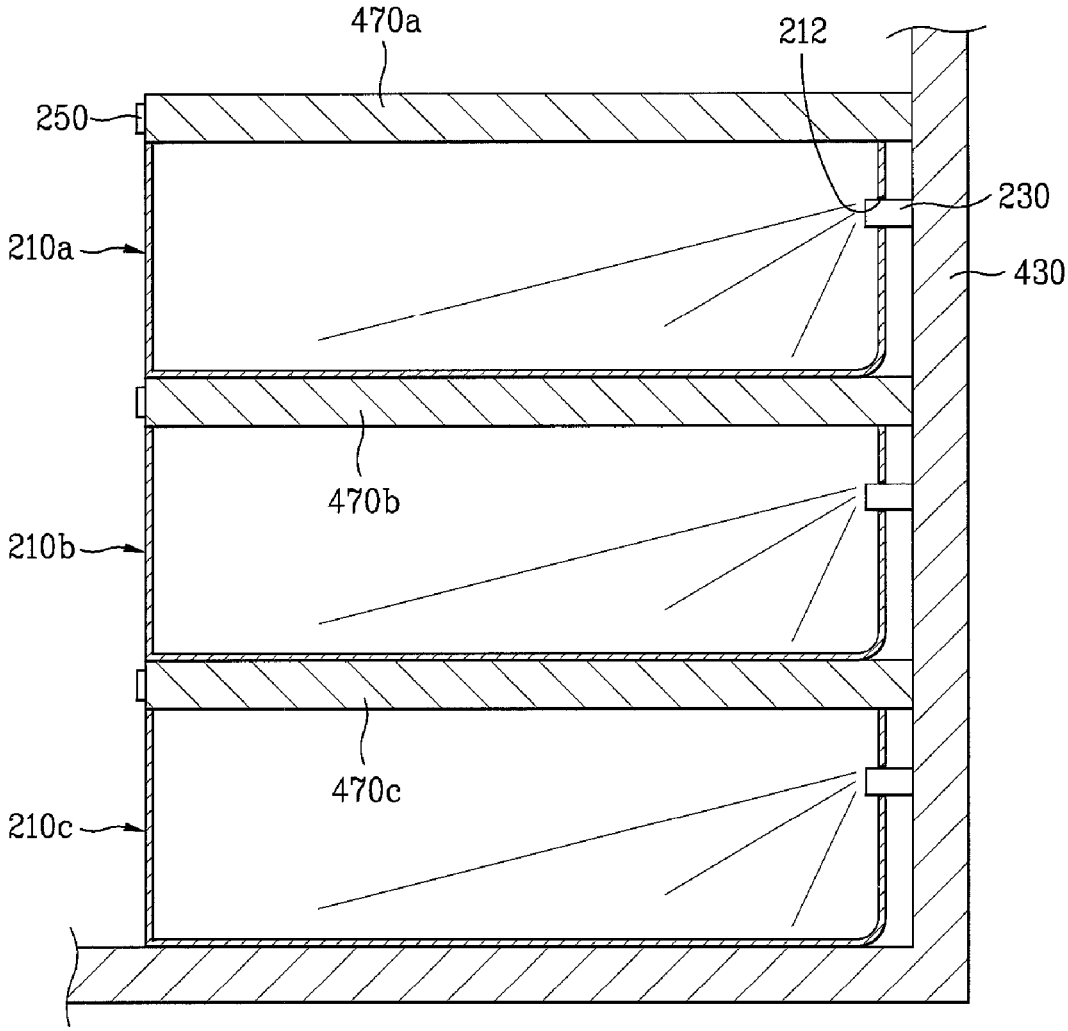
FIGS. 11 and 12 are sectional views of FIG. 10.
Figure 12:
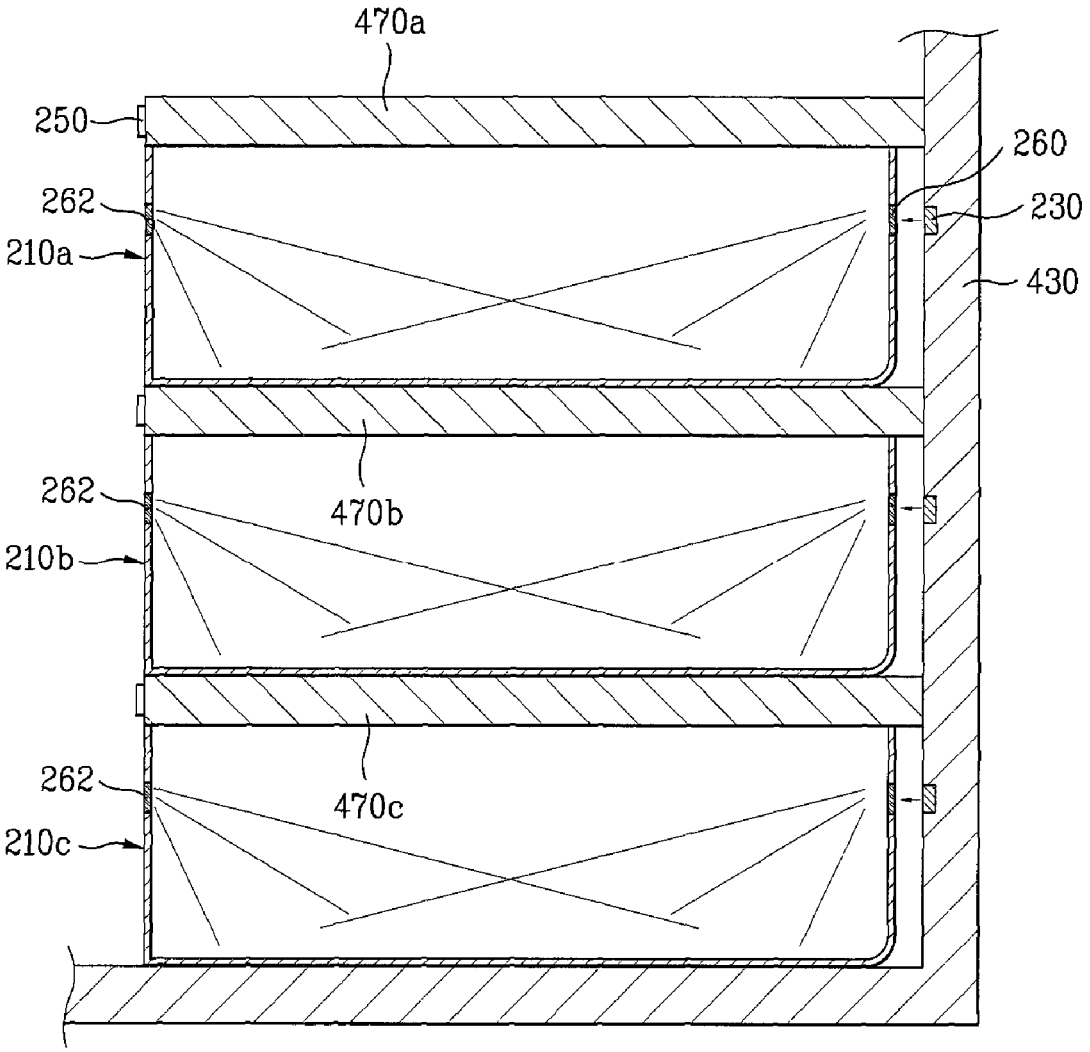
Figure 13:
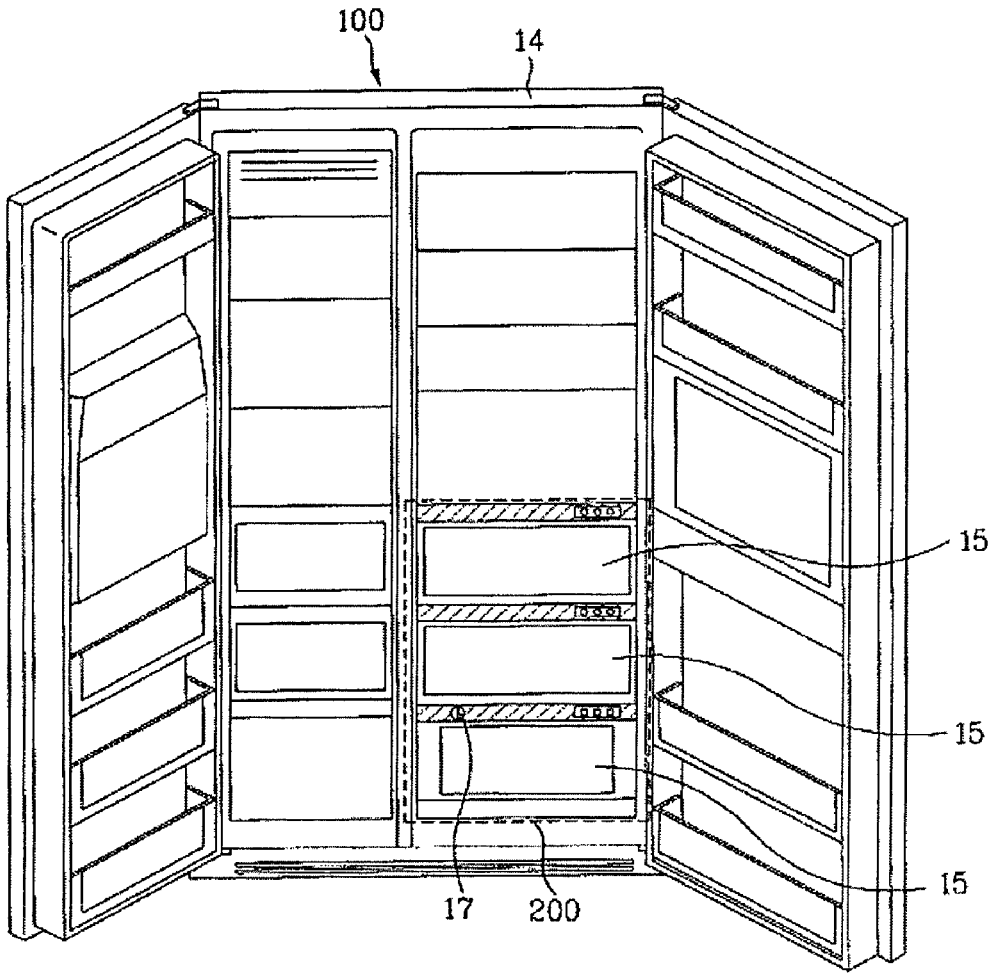
FIG. 13 is a perspective view showing a refrigerator in accordance with another embodiment of the present invention.
Figure 14:
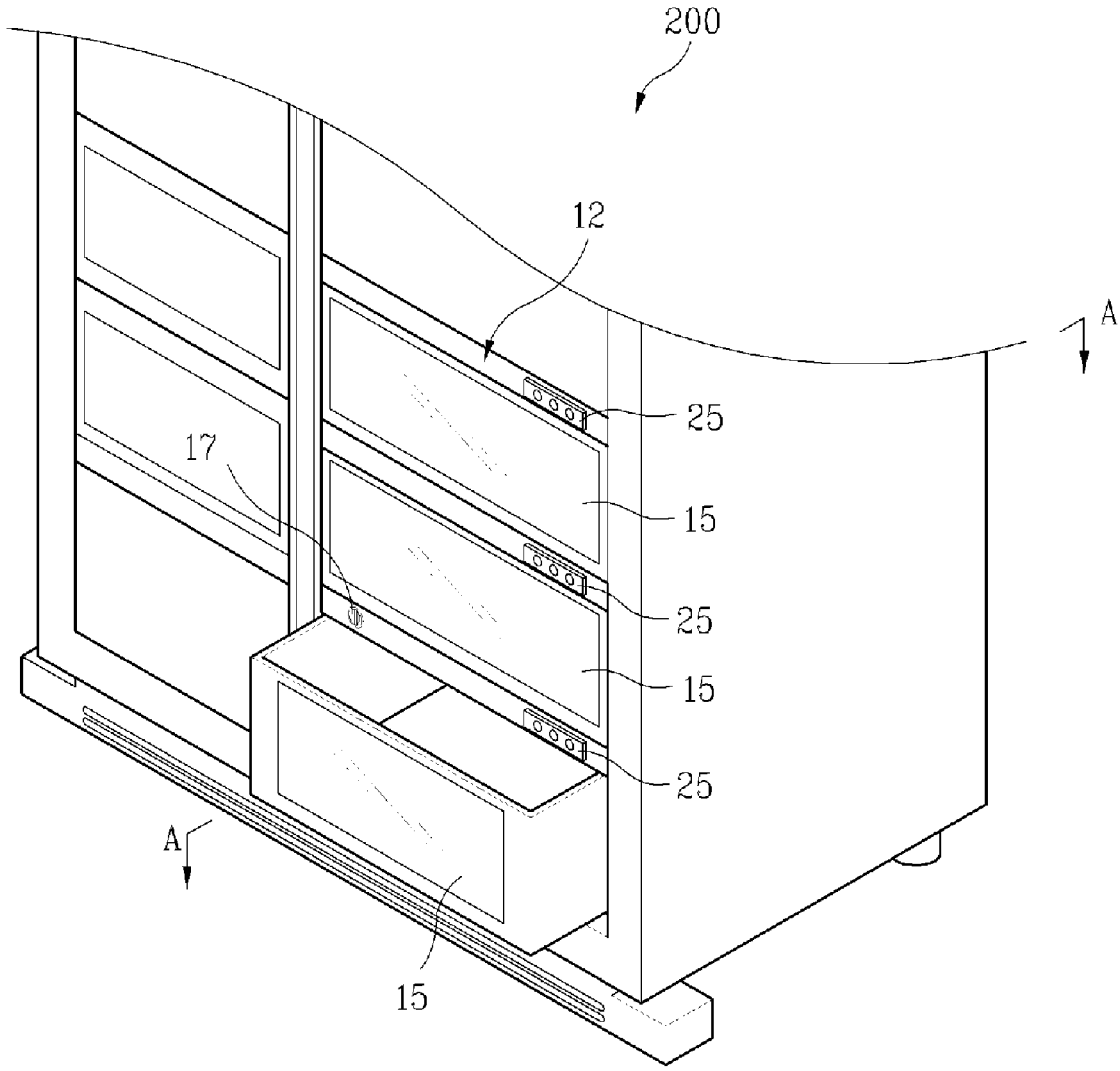
FIG. 14 is a perspective view showing a vegetable compartment of a refrigerator depicted in FIG. 13.

Referring to FIGS. 11 and 12, a refrigerator according to another embodiment of the present invention will now be described.

This embodiment relates to a mounting structure of the light source 230. The mounting structure according to this embodiment can be applied to all of the previous embodiments, and is especially useful for the point light source.

When the light source 230 is mounted to the vegetable box 210*a*, the light irradiation efficiency is higher. But, it is not convenient to mount the light source 230 to the vegetable box 210*a*. This is because the connection of electric wires are complicated when the light source 230 is mounted to the vegetable box 210*a*. Accordingly, in terms of the installment of the light source 230, it is preferable that the light source 230 is mounted to the inner wall of the vegetable compartment, i.e., the partition wall of the refrigerator. Because the upper portion of the vegetable box 210*a* is generally opened, the light irradiation efficiency of the light source 230 mounted to the upper portion of the vegetable box 210*a* is not affected, but the light irradiation efficiency of the light sources 230 mounted to the front, side and rear portions may be decreased. This is because the vegetable box 210*a* is not generally made of perfectly transparent material and thus light emitted from the light source 230 mounted outside the vegetable box 210*a* cannot completely penetrate through the vegetable box 210*a*. This embodiment solves the above problem.

Referring to FIG. 11, the light source 230 is mounted to the inner wall of the vegetable compartment, e.g., the rear surface of the vegetable compartment. That is, the light source 230 is protrudingly mounted to a rear partition wall 430 of the refrigerator, and the vegetable box 210*a* is formed with an opening 212 corresponding to the light source 230. When the vegetable box 210*a* is put into the vegetable compartment, the light source 230 is inserted through the opening 212 of the vegetable box 210*a* and the opening 212 is blocked. Accordingly, the vegetable box 210*a* is kept in a sealed state.

FIG. 12 shows another mounting structure of the light source 230.

As shown in FIG. 12, the light source 230 is mounted in the rear partition wall 430 of the refrigerator, and the vegetable box 210*a* is provided with a light scattering member 260 corresponding to the light source 230. The light scattering member 260 scatters light emitted from the light source 230 so that the light is evenly spread to the vegetables stored in the vegetable box 210*a*. The vegetable box 210*a* is further provided with a reflection plate 262 at a position opposite to the light scattering member 260. By the light being reflected from the reflection plate 262, the light can be more evenly irradiated to the vegetables.

The light scattering member 260 and the reflection plate 262 may be formed integrally or separately with/from the vegetable box 210*a*. Also, the sizes of the light scattering member 260 and the reflection plate 262 are not limited to specific values, and can be adequately varied. When the light scattering member 260 and the reflection plate 262 occupy parts of the vegetable box 210*a*, it is preferable to change a transmittance of the corresponding parts of the vegetable box 210*a* so that light emitted from the light source 230 can be more evenly spread in the vegetable box 210*a*.

A refrigerator according to another embodiment of the present invention will now be described with reference to FIGS. 13 to 16.

A refrigerator 100 comprises a main body 14 having a cooling chamber, and a storage container 200 which is provided in the cooling chamber of the main body 14 to store foodstuffs. The storage container 200 includes a body 10 which is mounted in the cooling chamber and formed with a storage chamber 11 and an insertion part 13, an irradiation device 20 which is mounted to the insertion part 13 of the body 10 and irradiates light toward the storage chamber 11, and a light permeation member 30 which shields the insertion part 13 of the body 10 and through which light emitted from the irradiation device 20 penetrates.

The body 10 has a function as the foodstuff storage container which is provided at a lower portion of the refrigerator. The body 10 has the storage chamber 11 which is defined by a bottom wall and left and right side walls. Preferably, the body 10 has a plurality of storage chambers 11 for classifying foodstuff's and separately storing the classified foodstuffs.

A sliding-type storage box 15 is coupled to the storage chamber 11 of the body 10 to easily put or pull foodstuffs into/out of the storage box 15. However, the means for storing foodstuffs is not limited to the sliding-type storage box 15 of this embodiment, and can be variously modified into other forms like a door hingedly coupled to an upper portion of the body 10.

In order to prevent moisture from leaking, it is preferable to form the body 10 and the storage box 15 to be kept in an airtight state. By the airtight structure of the body 10 and the storage box 15, an adequate humidity can be maintained for a long time by moisture transpired from foodstuffs.

Figure 15:
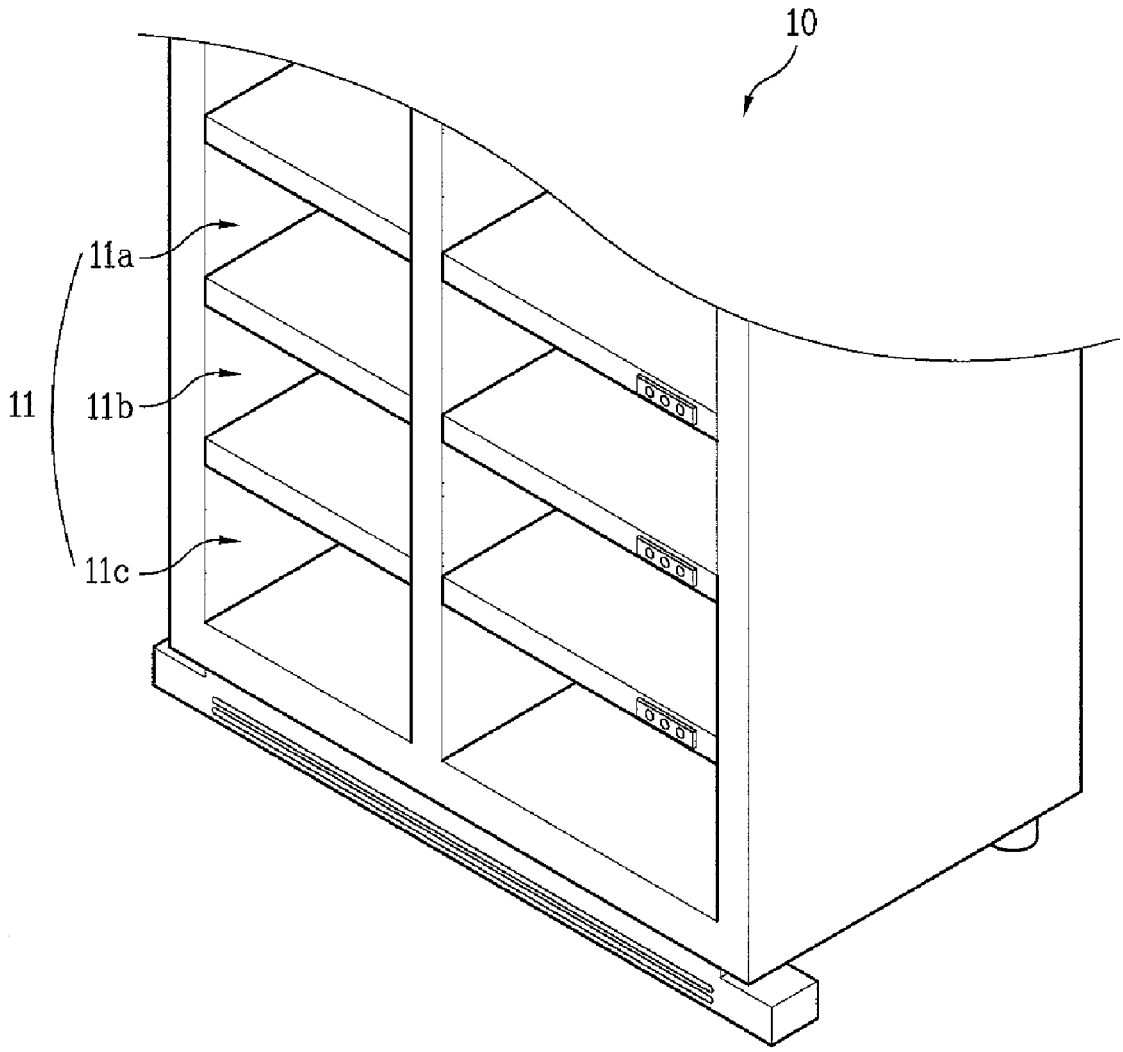
FIG. 15 is a perspective view showing a body of a vegetable compartment depicted in FIG. 14.
Figure 16:
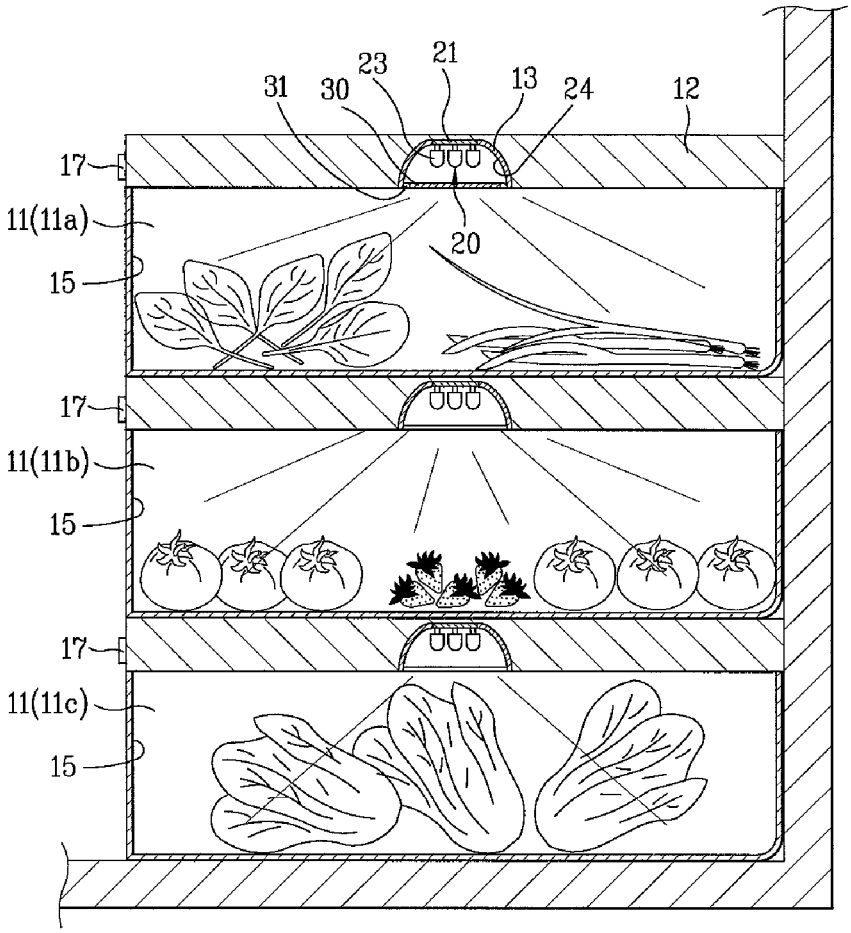
FIG. 16 is a sectional view taken along line A-A in FIG. 14.

The body 10 may have a plurality of storage chambers 11. In this embodiment, as shown in FIGS. 15 and 16, the storage container 100 is constituted by a plurality of storage chambers 11 which are partitioned in a vertical direction. At least one of the storage chambers 11 is provided with a temperature adjusting device 17 to selectively store meats and vegetables.

The insertion part 13 is formed at the inner surface of the body 10. The insertion part 13 is opened toward the storage chamber 11, and the irradiation device 20 is insertedly mounted in the insertion part 13.

By the irradiation device 20 being insertedly mounted in the insertion part 13 of the body 10, the breakage of the irradiation device 20 due to the collision with the foodstuffs when the storage box 15 slides is prevented.

The irradiation device 20 includes a substrate 21, and light emitting elements 23 mounted on the substrate 21. Preferably, the light emitting element 23 is embodied by a light emitting diode (LED) which has relatively low heat generation and relatively high light emitting efficiency. By using the LED as the light emitting element 23 in this embodiment, heat generated from the irradiation device 20 can be minimized, and operational efficiency can be increased.

The irradiation device 20 irradiates light within a visible light region to the storage chamber 11. The mounting position of the irradiation device 20 has no limitation. The irradiation device 20 can be selectively mounted to the upper and lower portions of the storage chamber 11 or the outer side surfaces of the storage chamber 11.

For reference, visible light means light which has a wavelength range, of about 380 to 770 nm, which is commonly visible to a person's eyes. The change of nature of the visible light according to the wavelength is represented by a color. That is, as it progresses from red to violet, the wavelength becomes shortened. For example, the wavelength of red light is in the range of 700-610 nm, the wavelength of orange light is 610-590 nm, the wavelength of yellow light is 590-570 nm, the wavelength of green light is 570-500 nm, the wavelength of blue light is 500-450 nm, and the wavelength of violet light is 450-400 nm.

When the infrared light, which has the wavelength longer than 770 nm, is irradiated, the temperature in the storage chamber 11 and the surface temperature of the stored foodstuffs are increased. Thus, the foodstuffs deteriorate quickly. For this reason, it is preferable that the irradiation device 20 is designed to emit light within the visible light region. Because the red visible light region is not accurately discriminated from the infrared light region, the visible light region defined in the present invention includes a partial infrared light region which has the range of the wavelength near the wavelength of the red visible light region.

The irradiation device 20 of the present invention is configured such that emitting color can be changed according to the color of the foodstuffs stored in the storage chamber 11.

By experiments, the applicant of the present invention has found that when the emitting color of the irradiation device 20 matches with the color of the stored foodstuffs, it is most effective to the maintenance of freshness of the foodstuffs and nutritive elements. For example, the red light is irradiated to red foodstuffs, and the green light is irradiated to green foodstuffs.

Based on the above facts, this embodiment is structured such that many kinds of foodstuffs are classified by colors and the emitting color of light irradiated to foodstuffs is changed according to the color of foodstuffs. More particularly, when the color of the stored foodstuffs is red, the irradiation device 20 is set to irradiate the red light to the stored foodstuffs, and when the color of the stored foodstuffs is green, the irradiation device 20 is set to irradiate the green-white combined light to the stored foodstuffs.

The foodstuffs stored in the storage container 100 may be primarily classified into vegetables and fruits. Further, the vegetables may be classified into leafy and stem vegetables, leaves and/or stems of which are used, root vegetables, roots and/or sub-terranean stems of which are used, and fruit vegetables, fruits of which are used.

In the present invention, the above various kinds of vegetables and fruits are classified by red and green, and the irradiation device is set to irradiate light of different emitting colors to the classified foodstuffs.

For example, strawberry, tomato, plum or the like belong to the red foodstuffs, and spinach, Chinese cabbage, cabbage or the like belong to the green foodstuffs.

The applicant of the present invention has performed an experiment of classifying the foodstuffs by red and green, irradiating red light to the red foodstuffs by use of the red LED, irradiating green-white combined light to the green foodstuffs by use of the green LED and the white LED, and measuring the variation of freshness of the stored foodstuffs after a predetermined period.

According to the experimental results, discoloration and dryness phenomena were considerably decreased in the green foodstuffs, and mold and tenderness phenomenon were almost not generated in the red foodstuffs, as compared to the case of indiscriminately irradiating visible light by use of the white LED.

FIG. 16 shows an example of classifying the foodstuffs by colors and separately storing the classified foodstuffs in the storage chambers 11. More particularly, Chinese cabbage and green onion belonging to the green foodstuffs are stored in a first storage chamber 11*a* which is located at an uppermost position of the storage chambers 11, tomato and strawberry belonging to the red foodstuffs are stored in a second storage chamber 11*b* which is located at a middle position, and cabbage belonging to the green foodstuffs is stored in a third storage chamber 11*c* which is located at a lowermost position.

Figure 17:
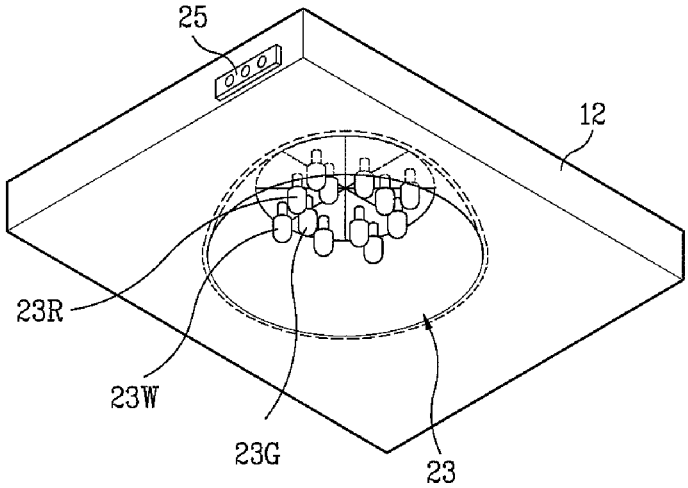
FIG. 17 is a bottom perspective view showing an upper panel of a vegetable compartment depicted in FIG. 14.

Referring to FIG. 17, the arrangement of the light emitting elements of the irradiation device of the present invention will now be described.

The light emitting elements 23 may be positioned and arranged very diversely, however, it is most preferable to dispose and arrange the light emitting elements 23 so as to evenly irradiate light to the stored foodstuffs. FIG. 17 shows an exemplary arrangement of the light emitting elements 23 of the irradiation device mounted to the first storage chamber 11*a*. As shown in FIG. 17, red LEDs 23R, green LEDs 23G and white LEDs 23W are disposed at a center portion of an upper panel 12 provided at an upper portion of the storage chamber 11 a.

Describing in detail, the center portion of the upper panel 12 to which the LEDs are mounted is formed in a circle shape, and the circle-shaped center portion of the upper panel 12 is equiangularly partitioned. The red, green and white LEDs 23R, 23G and 23W are disposed at the respective partitioned fanwise regions.

At this time, because the green LED 23G and the white LED 23W are driven together to irradiate light to the green foodstuffs, the green LED 23G and the white LED 23W are arranged adjacently to each other in the respective fanwise regions.

The storage chambers 11 are further provided with selecting devices 25 for changing the emitting colors of light from the irradiation device 20, corresponding to the colors of the foodstuffs respectively stored in the first to third storage chambers 11*a*, 11*b* and 11*c*. For example, by manipulating the selecting device 25, the red LEDs 23R and the green and white LEDs 23G and 23W are selectively driven to irradiate the red light or the green-white combined light to the foodstuffs stored in the first storage chamber 11 a.

In this embodiment, the selecting device 25 is disposed at a front surface of the upper panel 12. The selecting device 25 includes three buttons. First and second buttons are for inputting the information of the color (i.e., red or green) of the stored foodstuffs, and a third button is for stopping the operation of the irradiation device 20.

For example, when the red foodstuffs are stored in the first storage chamber 11*a*, if the user presses the first button of the selecting device 25, the red LEDs 23R of the irradiation device 20 are driven to irradiate the red light to the red foodstuffs. On the other hand, when the green foodstuffs are stored in the first storage chamber 11*a*, if the user presses the second button of the selecting device 25, the red LEDs 23R of the irradiation device 20 are turned of and the green and white LEDs 23G and 23W are driven to irradiate the green-white combined light to the green foodstuffs.

Meanwhile, instead of the above selecting device 25, a color recognition device (not shown) like a camera capable of recognizing the color of the stored foodstuffs may be mounted in the storage chamber 11. If so, it is unnecessary for the user to confirm the color of the stored foodstuffs, and the color recognition device detects the color of the stored foodstuffs and automatically drives the adequate LEDs for the color of the foodstuffs, thereby increasing convenience in use.

It is preferable that the storage container 200 is provided with an opening/closing sensor (not shown) for determining whether the storage chamber 11 is opened or closed. Only when the opening/closing sensor determines that the storage chamber 11 is closed, the irradiation device 20 is driven to irradiate light.

Figure 18:
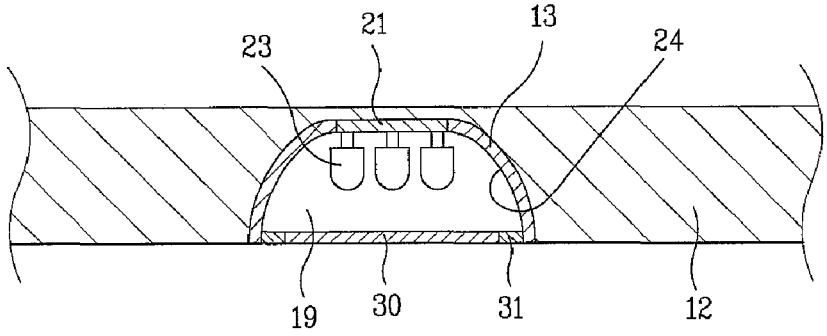
FIG. 18 is a side-sectional view showing an irradiation device depicted in FIG. 17.
Figure 19:
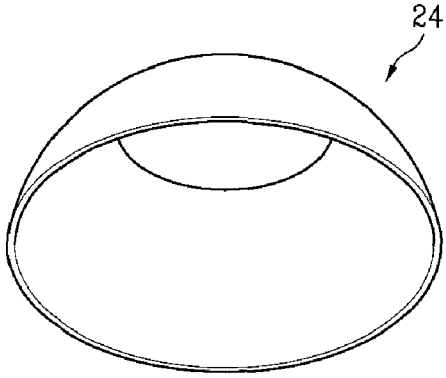
FIG. 19 is a perspective view showing a reflection plate.

As shown in FIGS. 18 and 19, the insertion part 13 of the body 10 is provided with a reflection plate 24 for reflecting the light emitted from the irradiation device 20 toward the storage chamber 11.

The reflection plate 24 is formed in an opened semispherical shape so as to effectively reflect the light emitted from the light emitting elements 23 of the irradiation device 20 toward the storage chamber 11. Preferably, the reflection plate 24 is made of aluminium which is electrolytically polished to prevent the change of the color of the light emitted from the light emitting elements 23 and increase light reflection efficiency. However, the material of the reflection plate 24 is not limited to the aluminium, but the reflection plate 24 can be made of glass or chromium coated material having high light reflectance.

An exemplary modification of the reflection plate of the present invention will now be described with reference to FIG. 20.

Figure 20:
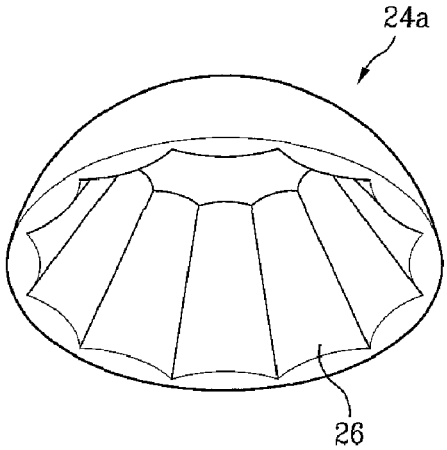
FIG. 20 is a perspective view showing an exemplary modification of a reflection plate.

As shown in FIG. 20, a semispherical-shaped reflection plate 24*a* of this embodiment is formed with a plurality of convex portions 26 at its bottom surface. The plurality of convex portions 26 extend in a radial direction. The light emitting elements 23 are mounted at a center portion of the bottom surface of the reflection plate 24*a*. The light emitted from the light emitting elements 23 is diffusely reflected by the convex portions 26 extending in the radial direction. Accordingly, the light can be more widely irradiated into the storage chamber 11. Of course, the shape and the arrangement of the convex portions 26 can be variously modified.

The light permeation member 30 is coupled to the opened portion of the insertion part 13 to seal the insertion part 13. A sealing member 31 of rubber material is fitted between the light permeation member 30 and the insertion part 13, to prevent moisture from permeating into the light emitting elements 23.

Preferably, the light permeation member 30 is embodied by a polarized light filter (PL filter) so that the light emitted from the light emitting elements 23 can be evenly spread in the storage chamber 11. When the light emitted from the light, emitting elements 23 penetrates through the polarized light filter, because the light is refracted in several directions, the light can be more widely irradiated into the storage chamber 11. The light permeation member 30 is not limited to the polarized light filter, and can be embodied by a concave lens which can change the refractive index according to the area of the storage chamber 11.

Hereinafter, the operational effect of the above-structured refrigerator according to the present invention will be described. The user classifies the foodstuffs by colors, and puts the classified foodstuffs into the respective storage chambers. In the case that the color recognition device is provided at the storage chambers, the color recognition device automatically recognizes the color of the foodstuffs stored in the storage chambers.

The light within the visible light region is irradiated into the respective storage chambers in which the foodstuffs classified by colors are respectively stored. At this time, the emitting color of the light irradiated into the storage chambers is decided correspondingly to the color of the foodstuffs stored in the storage chambers.

Also, the user can manipulate the selecting device to manually change the emitting color of the light correspondingly to the color of the foodstuffs stored in the storage chambers.

Because the light emitting elements are insertedly mounted in the insertion part of the body, the breakage of the light emitting elements due to the collision with the foodstuffs stored in the storage chambers is prevented.

Also, since the light emitting elements are shielded by the light permeation member which is embodied by the polarized light filter or the concave lens, moisture does not permeate into the light emitting elements, thereby preventing the damage of the substrate due to a short. Furthermore, since the light emitted from the light emitting elements is refracted in several directions while penetrating through the diffused reflection light filter or the concave lens, the light can be more widely and evenly irradiated into the storage chambers.

Figure 21:
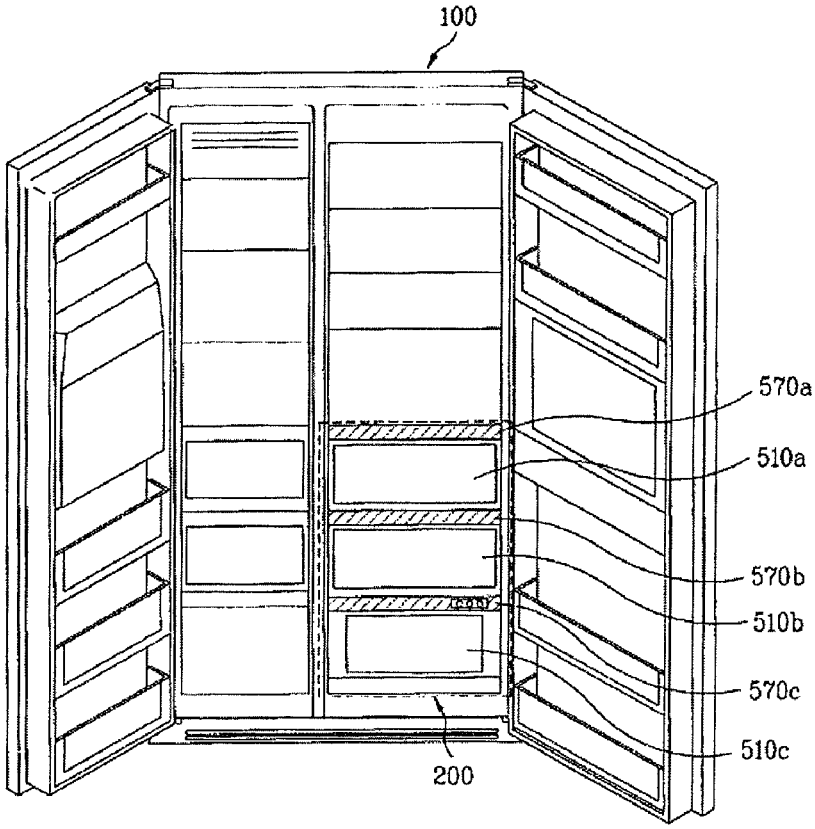
FIG. 21 is a perspective view showing a refrigerator in accordance with another embodiment of the present invention.
Figure 22:
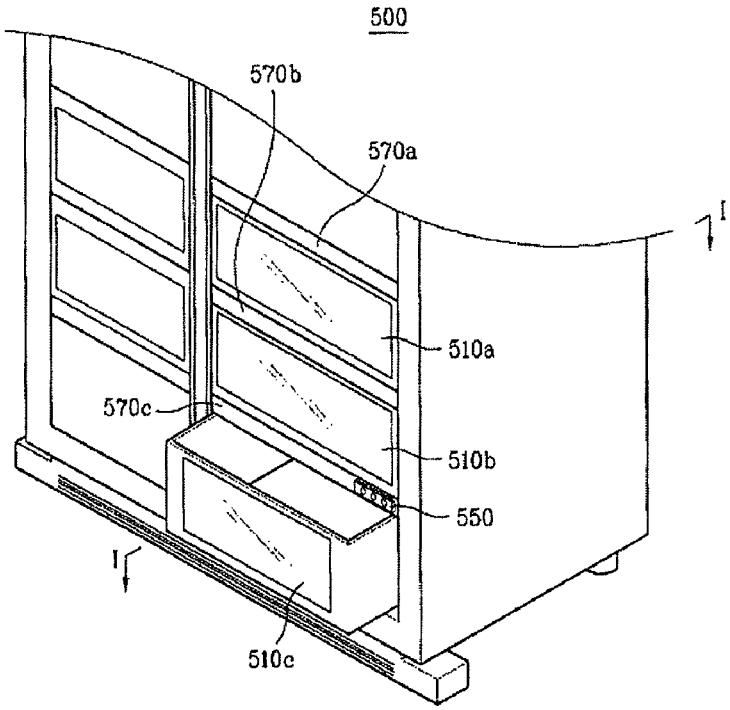
FIG. 22 is a perspective view showing a vegetable compartment of a refrigerator depicted in FIG. 21.
Figure 23:
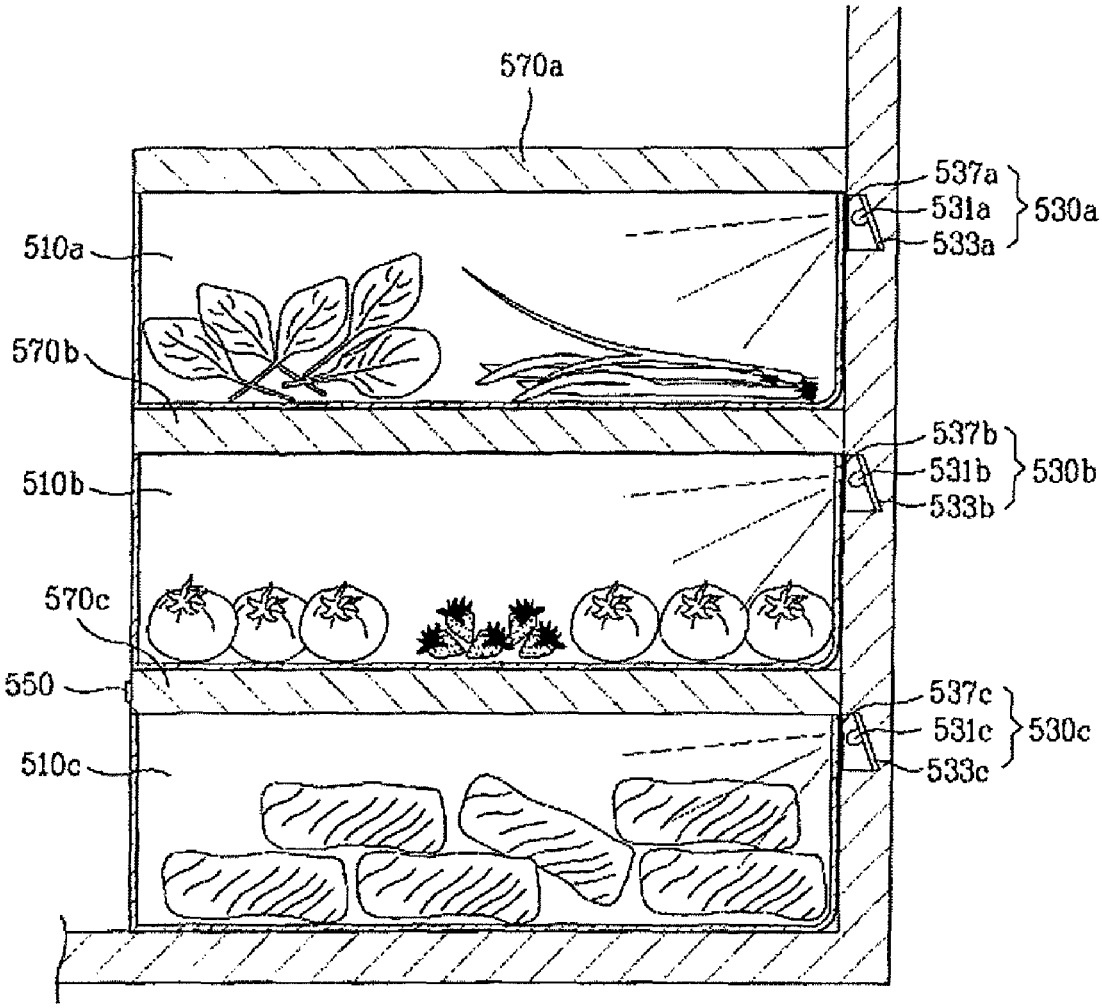
FIG. 23 is a sectional view taken along line I-I in FIG. 22.

Referring to FIGS. 21 to 23, a refrigerator according to another embodiment of the present invention will now be described.

A vegetable compartment 200 is provided at a lower portion of a cooling chamber. The vegetable compartment 200 includes several vegetable storage chambers 510*a*, 510*b* and 510*c*, irradiation devices 530*a*, 530*b* and 530*c*, and a selecting device 550.

The storage chambers 510*a*, 510*b* and 510*c* provide foodstuffs storage space, and are defined by a bottom wall and left and right side walls. In this embodiment, the storage chambers 510*a*, 510*b* and 510*c* are opened and closed by a sliding type so that the user easily puts or pulls foodstuffs into/out of the storage chambers 510*a*, 510*b* and 510*c*.

However, the opening/closing type of the storage chambers 510*a*, 510*b* and 510*c* is not limited to the sliding type, and can be variously modified into other types like a door hingedly coupled to an upper portion of the storage chambers 510*a*, 510*b* and 510*c*.

In order to prevent moisture from leaking, it is preferable to form the storage chambers 510*a*, 510*b* and 510*c* to be kept in an airtight state. By the airtight structure of the storage chambers 510*a*, 510*b* and 510*c*, an adequate humidity can be maintained for a long time by moisture transpired from foodstuffs.

In this embodiment, as shown in FIG. 23, the vegetable compartment 200 includes three vegetable storage chambers 510*a*, 510*b* and 510*c* which are partitioned in a vertical direction.

The irradiation devices 530*a*, 530*b* and 530*c* irradiate light within the visible light region into the partitioned storage chambers 510*a*, 510*b* and 510*c*, respectively.

Any light source may be used as light emitting elements 531*a*, 531*b* and 531*c* of the irradiation devices 530*a*, 530*b* and 530*c*. However, it is preferable that the light emitting elements 531*a*, 531*b* and 531*c* are embodied by a light emitting diode (LED) which has relatively low heat generation and relatively high light emitting efficiency.

By using the LEDs as the light emitting elements 531*a*, 531*b* and 531*c*, the heat generated from the irradiation devices 530*a*, 530*b* and 530*c* is minimized, and the rise of the temperature by the light emitting elements 531*a*, 531*b* and 531*c* are decreased. Accordingly, the irradiation devices 530*a*, 530*b* and 530*c* can be driven with relatively low power consumption.

Meanwhile, the irradiation device 530*c* for irradiating the light into the lowermost storage chamber 510*c* is designed to irradiate the light of different color combinations within the visible light region according to the kind of the foodstuffs stored in the storage chamber 510*c*.

As described above, according to the experiments executed by the applicant of the present invention, when the emitting color of the irradiation device matches with the color of the stored foodstuffs, it is most effective to the maintenance of freshness of the foodstuffs and nutritive elements. In particular, it is effective to irradiate the green-white combined light to vegetables, and to irradiate the red-blue combined light to meats.

Based on the above experimental results, in this embodiment, vegetables are stored in the first storage chamber 510*a* which is located at an uppermost position of the storage chambers and the second storage chamber 510*b* which is located at a middle position. The irradiation devices 530*a* and 530*b* mounted in the first and second storage chambers 510*a* and 510*b* are set to indiscriminately irradiate the green-white combined light. And, the irradiation device 530*c* mounted in the lowermost third storage chamber 510*c* is set to irradiate the light of different combinations according to the kind of the foodstuffs stored in the third storage chamber 510*c*.

For example, when vegetables are stored in the third storage chamber 510*c*, the irradiation device 530*c* irradiates the green-white combined light. On the other hand, when meats are stored in the third storage chamber 510*c*, the irradiation device 530*c* irradiates the red-blue combined light. FIG. 23 shows an exemplary state in which vegetables are stored in the first storage chamber 510*a* and the second storage chamber 510*b*, and meats are stored in the third storage chamber 510*c*.

With respect to the third storage chamber 510*c* in which vegetables and meats are selectively stored, it is preferable to adjust an inner temperature of the third storage chamber 510*c* at the same time when the irradiation device 530*c* irradiates the light of the adequate color combination for the kind of the foodstuffs stored in the third storage chamber 510*c*. For example, when storing vegetables, the inner temperature of the third storage chamber 510*c* is adjusted to be about 3° C. When storing meats, the inner temperature of the third storage chamber 510*c* is adjusted to be about −2° C. Meats are stored at the lower temperature than vegetables.

The mounting position of the irradiation devices 530*a*, 530*b* and 530*c* has no limitation. The irradiation devices 530*a*, 530*b* and 530*c* can be selectively mounted to the upper and lower portions of the storage chambers 510*a*, 510*b* and 510*c*. As shown in FIG. 23, this embodiment is configured such that the irradiation devices 530*a*, 530*b* and 530*c* are disposed at outer rear-upper portions of the storage chambers 510*a*, 510*b* and 510*c*, i.e., a rear partition wall of a main body 100 of the refrigerator.

The irradiation devices 530*a*, 530*b* and 530*c*, as shown in FIG. 23, include substrates 533*a*, 533*b* and 533*c*, light emitting elements 531*a*, 531*b* and 531*c* mounted to the substrates 533*a*, 533*b* and 533*c*, and protective covers 537*a*, 537*b* and 537*c* for preventing permeation of moisture into the light emitting elements 531*a*, 531*b* and 531*c* and damage of the light emitting elements 531*a*, 531*b* and 531*c*. Preferably, the protective covers 537*a*, 537*b* and 537*c* are made of light permeable material, and the surface of the protective covers 537*a*, 537*b* and 537*c* are corrosion-treated so that the light penetrating through the protective covers 537*a*, 537*b* and 537*c* are scattered and an irradiation angle is broadened.

The selecting device 550 is for inputting information of the kind of foodstuffs stored in the third storage chamber 510*c* and deciding the emitting color of light emitted from the irradiation device 530*c*, corresponding to the color of the foodstuffs stored in the third storage chamber 510*c*. The detailed constitution of the selecting device 550 will be described later with reference to FIGS. 25 and 26.

It is preferable that the vegetable compartment 200 is provided with an opening/closing sensor (not shown) for determining whether the storage chambers 510*a*, 510*b* and 510*c* are opened or closed. Only when the opening/closing sensor determines that the storage chambers 510*a*, 510*b* and 510*c* are closed, the irradiation devices 530*a*, 530*b* and 530*c* are driven to irradiate light.

Figure 24:
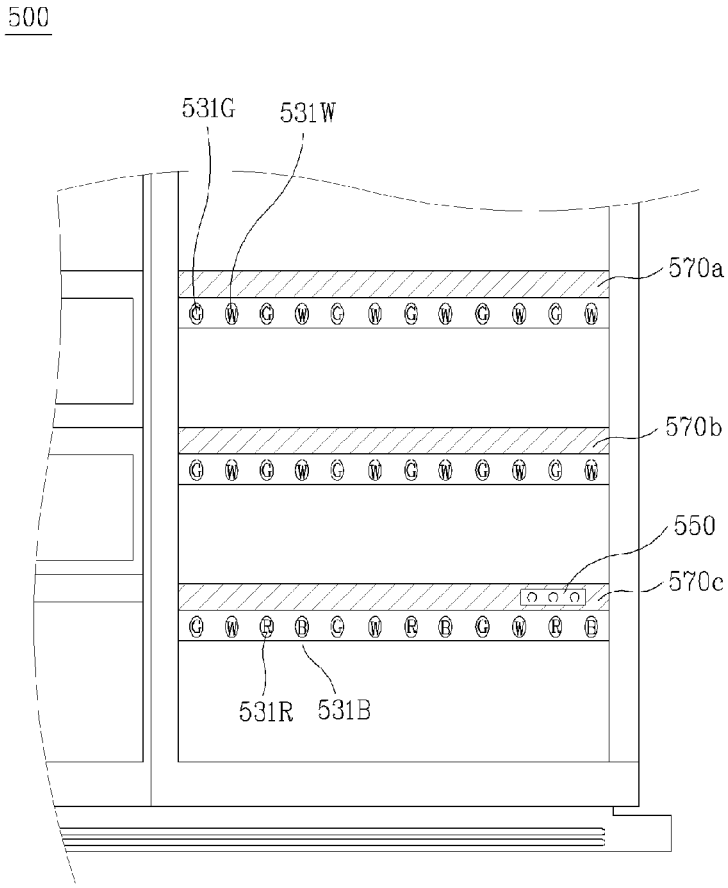
FIG. 24 is a front view showing a rear surface of a vegetable compartment depicted in FIG. 22.

Referring to FIG. 24, the arrangement structure of the light emitting elements of the irradiation devices will now be described.

The light emitting elements 531*a*, 531*b* and 531*c* may be positioned and arranged very diversely, however, it is most preferable to dispose and arrange the light emitting elements 531*a*, 531*b* and 531*c* so as to evenly irradiate light to the stored foodstuffs.

FIG. 24 shows an exemplary arrangement of the light emitting elements 531*a*, 531*b* and 531*c*. The light emitting elements 531*a*, 531*b* and 531*c* are disposed at the outer rear-upper portions of the storage chambers 510*a*, 510*b* and 510*c*, and arranged in a line in a horizontal direction.

The first storage chamber 510*a* and the second storage chamber 510*b* are for storing vegetables, and the irradiation devices 530*a* and 530*b* mounted to the first and second storage chambers 510*a* and 510*b* are constituted by green LEDs 531G and white LEDs 531W which are alternately arranged with a regular gap therebetween (as described above, the green LEDs 531G and the white LEDs 531W are adequate for vegetables).

The third storage chamber 510*c* is for selectively storing vegetables and meats, and the irradiation device 530*c* mounted to the third storage chamber 510*c* is constituted by red LEDs 531R and blue LEDs 531B as well as the green LEDs 531G and white LEDs 531W (as described above, the red LEDs 531R and the blue LEDs 531B are adequate for meats). The green LEDs 531G, the white LEDs 531W, the red LEDs 531R and the blue LEDs 531B are alternately arranged with a regular gap therebetween. As shown in FIG. 24, because the green and white LEDs 531G and 531W are driven together for irradiating light to vegetables and the red and blue LEDs 531R and 531B are driven together for irradiating light to meats, the green LEDs 531G and the white LEDs 531W are disposed adjacent to each other, and the red LEDs 531R and the blue LEDs 531B are disposed adjacent to each other.

For even irradiation of the light, as shown in FIG. 24, each of the light emitting elements is formed in an elliptical shape, and each of the light emitting elements is disposed such that a major axis of the elliptical-shaped light emitting element is perpendicular to the arrangement direction of the light emitting elements.

Figure 25:
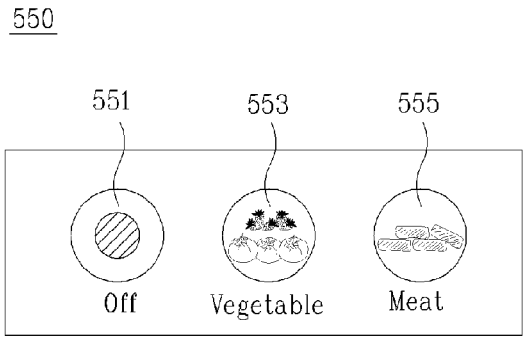
FIG. 25 is a front view showing a selecting device of a vegetable compartment depicted in FIG. 22.
Figure 26:
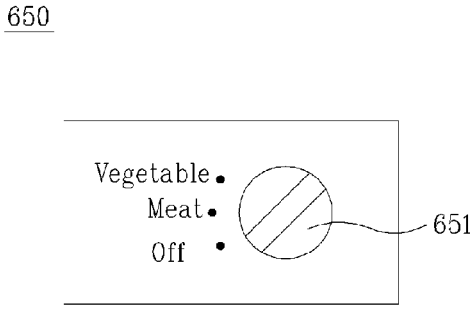
FIG. 26 is a front view showing an exemplary modification of a selecting device.

Referring to FIGS. 25 and 26, the constitution of the selecting device according to the present invention will now be described.

In this embodiment, the selecting device 550 is mounted to the front surface of the upper panel 570*c* of the third storage chamber 510*c*. FIGS. 25 and 26 illustrate the constitution of the selecting device 550.

As shown in FIG. 25, the selecting device 550 includes a first selecting part 551, a second selecting part 553, and a third selecting part 555. Based on the selected kind of foodstuffs, the selecting device 550 adequately changes the light emitted from the irradiation device 530*c*.

The first selecting part 551 has a function of turning off the irradiation device. When intending to stop the operation of the irradiation device, the user presses the first selecting part 551.

When the foodstuffs stored in the third storage chamber 510*c* are vegetables, the user presses the second selecting part 553. Then, the irradiation device irradiates the green-white combined light into the third storage chamber 510*c*.

When the foodstuffs stored in the third storage chamber 510*c* are meats, the user presses the third selecting part 555. Then, the irradiation device irradiates the red-blue combined light into the third storage chamber 510*c*.

In order to enable the user to easily discriminate the second selecting part 553 and the third selecting part 555 from each other, as shown in FIG. 25, designs of vegetables and meats are drawn on the button-shaped selecting parts 553 and 555.

FIG. 26 shows an exemplary modification of the selecting device. A selecting device 650 depicted in FIG. 26 is configured to operate by the rotation of a selecting lever 651.

Using the above-described selecting device 550 or 650, the user selects the kind of the stored foodstuffs (i.e., vegetables or meats) by manipulating the buttons or the lever, so that the irradiation device irradiates the light adequate for the color of the selected kind of the foodstuffs.

Figure 27:
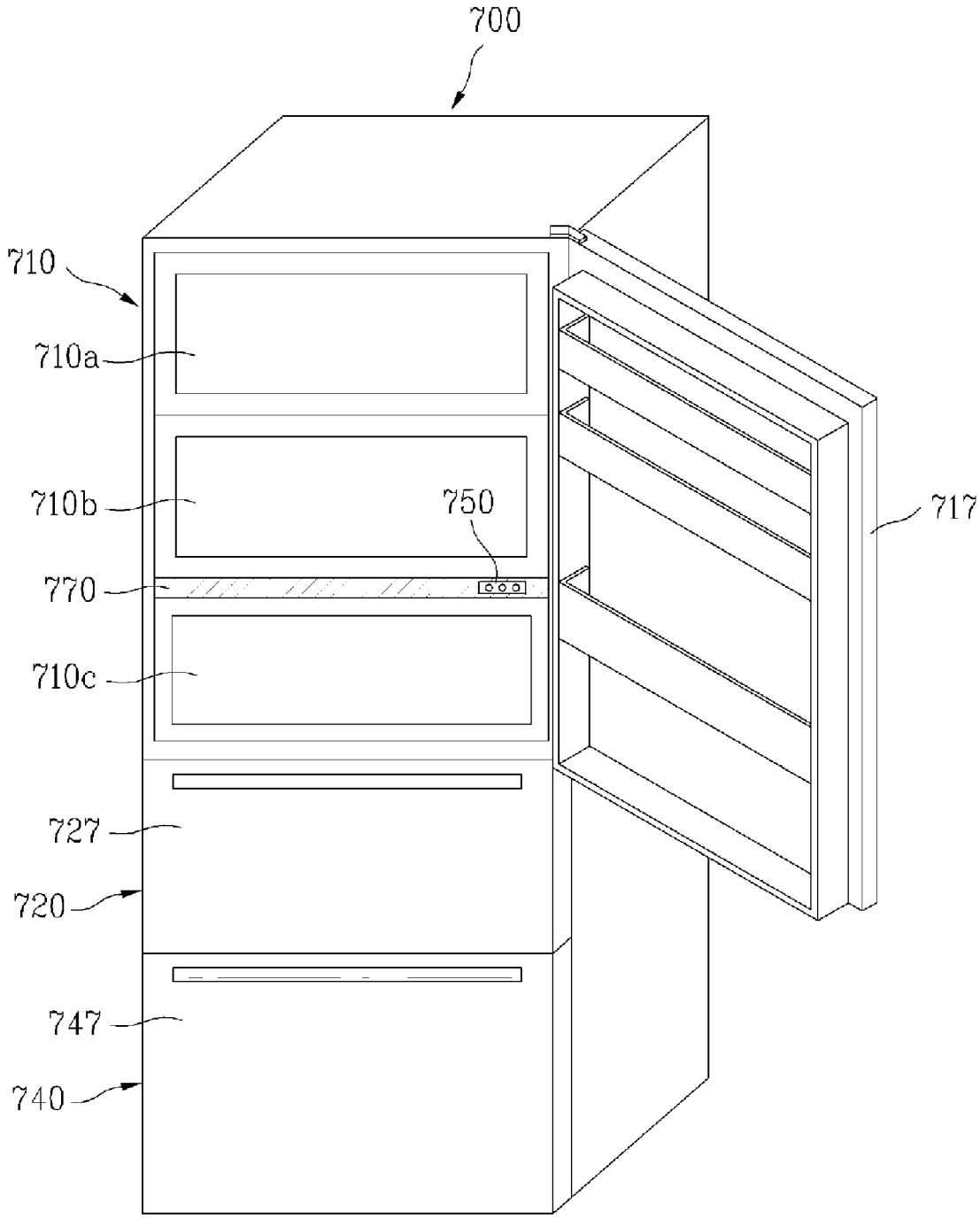
FIGS. 27 and 28 are perspective views showing a refrigerator in accordance with yet another embodiment of the present invention.

Referring to FIG. 27, a refrigerator according to another embodiment of the present invention will now be described.

A refrigerator of this embodiment is combined with a function of storing 'kimchi'. The refrigerator comprises a cooling chamber 710, an upper kimchi storage chamber 720, and a lower kimchi storage chamber 740.

A door 717 is hingedly coupled to a main body 700 of the refrigerator to open and close the cooling chamber 710. The upper and lower kimchi storage chambers 720 and 740 are opened and closed by drawer-type doors 727 and 747, respectively. The cooling chamber 710 provides a space for storing kimchi, or for storing vegetables or meats as needed.

In this embodiment, an irradiation device is mounted to the cooling chamber 710, more particularly, to a lowermost storage chamber 710*c* of storage chambers 710*a*, 710*b* and 710*c* of the cooling chamber 710. Accordingly, the lowermost storage chamber 710*c* can selectively store vegetables and meats, and the irradiation device mounted to the lowermost storage chamber 710*c* irradiates the light adequate for the kind of the stored foodstuffs, thereby maintaining freshness and nutritive elements for a long time. It is also possible to mount the irradiation device to all of the storage chambers 710*a*, 710*b* and 710*c*.

Although it is not illustrated in FIG. 27, the irradiation device includes green, white, red and blue LEDs which are arranged in a line at an outer rear portion of the storage chamber. Since the constitution of the irradiation device of this embodiment is the same as that of the irradiation device of the previous embodiments, the detailed description thereof will be omitted.

In this embodiment, a selecting device 750 is for inputting information of the kind of foodstuffs stored in the lowermost storage chamber 710*c* and adequately changing the light emitted from the irradiation device. The selecting device 750 is mounted to an upper panel 770 which is positioned at an upper portion of the storage chamber 710*c*.

Since the constitution of the selecting device 750 is the same as that of the selecting device illustrated in FIG. 25 of the previous embodiment, the detailed description thereof will be omitted.

Figure 28:
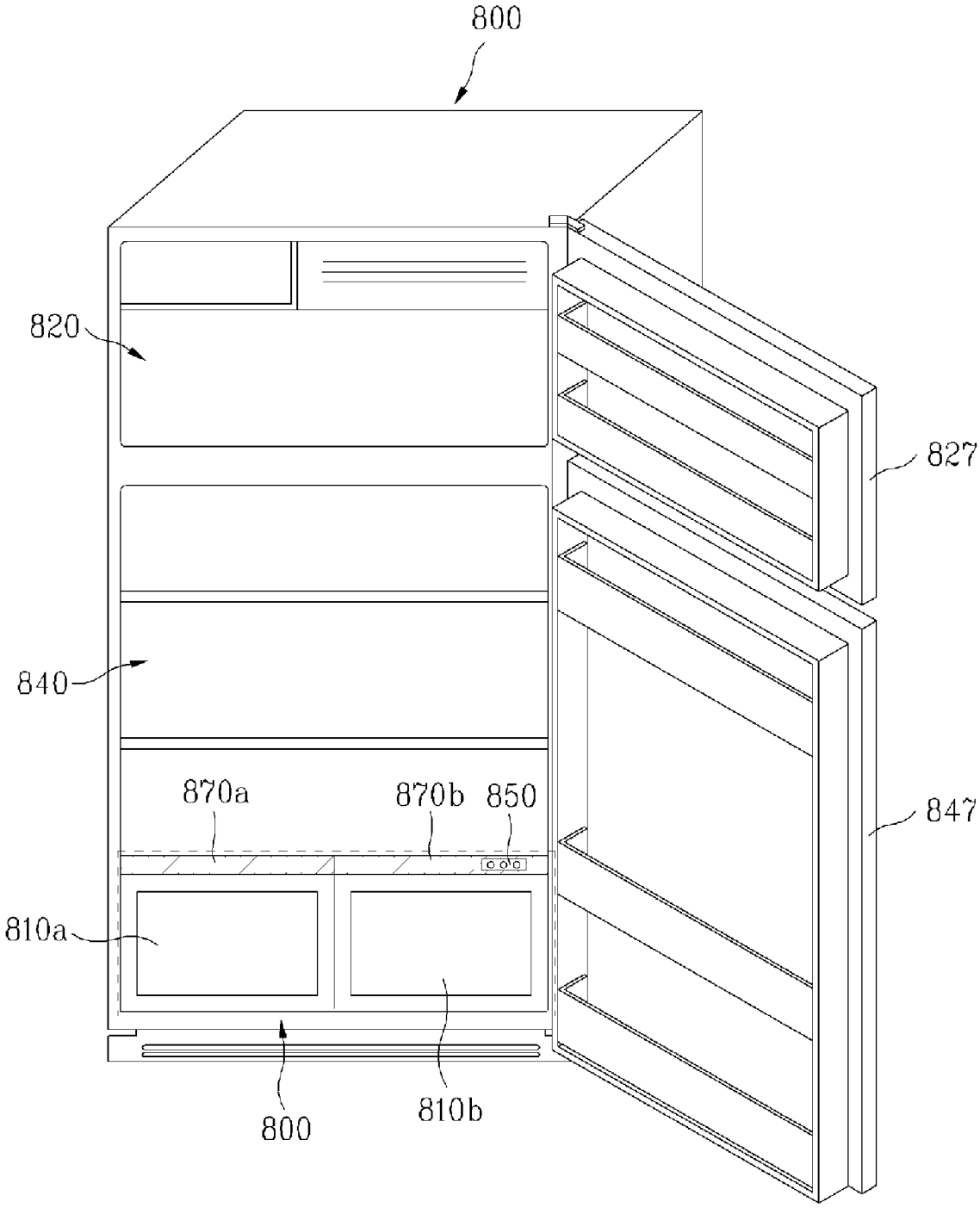

Referring to FIG. 28, a refrigerator according to yet another embodiment of the present invention will now be described.

As shown in FIG. 28, a refrigerator according to this embodiment comprises a freezing chamber 820 at its upper portion, and a cooling chamber 840 at its lower portion. A freezing chamber door 827 and a cooling chamber door 847 are hingedly coupled to a main body 800 of the refrigerator to open and close the freezing chamber 820 and the cooling chamber 840, respectively.

A vegetable compartment 810 including a left storage chamber 810*a* and a right storage chamber 810*b* is provided at a bottom portion of the cooling chamber 840. In this embodiment, an irradiation device is mounted to the vegetable compartment 810, more particularly, to the right storage chamber 810*b*. Accordingly, the right storage chamber 810*b* can selectively store vegetables and meats, and the irradiation device mounted to the right storage chamber 810*b* irradiates the light adequate for the kind of the stored foodstuffs, thereby maintaining freshness and nutritive elements for a long time.

Of upper panels 870*a* and 870*b* which are located at upper portions of the left and right storage chambers 810*a* and 810*b*, a selecting device 850, which is the same as the previous embodiment, is mounted to the upper panel 870*b* of the right storage chamber 810*b*.

Since the constitution of the irradiation device and the selecting device is the same as that of the previous embodiment, the detailed description thereof will be omitted.

Hereinafter, an operational principle of the refrigerator according to the present invention will be described. When the user stores vegetables or meats in the vegetable compartment, the irradiation device irradiates light within the visible light region to the stored foodstuffs. Especially, since the user can selectively input the information of the kind of the stored foodstuffs (i.e., vegetables or meats) by use of the selecting device, the irradiation device irradiates the adequate light for the kind of the stored foodstuffs. In particular, when vegetables are stored, the irradiation device irradiates the green-white combined light. On the other hand, when meats are stored, the irradiation device irradiates the red-blue combined light.

And, in cooperation with the irradiation of the irradiation device, the inner temperature of the storage chamber is adjusted correspondingly to the kind of the foodstuffs stored in the storage chamber.

Meanwhile, instead of the selecting device, if the color recognition device like a camera capable of recognizing the color of the stored foodstuffs is mounted in the storage chamber, it is unnecessary for the user to confirm the color of the stored foodstuffs, and the color recognition device detects the color of the stored foodstuffs and automatically drives the irradiation device to irradiate the light adequate for the color of the stored foodstuffs.

The present invention can be applied to all types of the refrigerator, e.g., the side-by-side type refrigerator in which the cooling chamber and the freezing chamber are partitioned in left and right sides, the top-mount type refrigerator in which the freezing chamber is positioned at the upper portion and the cooling chamber is positioned at the lower portion, and the french refrigerator in which the cooling chamber is positioned at the upper portion and the freezing chamber is positioned at the lower portion.

Also, in the above embodiments, the refrigerator having the vegetable compartment for primarily storing vegetables and fruits has been illustrated and explained, however, the present invention is not restricted to the above embodiments. The principle of the present invention can also be applied to kimchi refrigerators for primarily storing kimchi, rice containers for primarily storing cereals, and wine refrigerators for primarily storing alcoholic beverages. Further, the principle of the present invention can also be applied to devices for storing a variety of foodstuffs including meats.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

INDUSTRIAL APPLICABILITY

The refrigerator according to the present invention has industrial advantages as follows.

Because the light emitted from the light source can be evenly irradiated to the vegetables stored in the vegetable compartment, freshness of the vegetables can be maintained more effectively.

Also, by separately storing the foodstuffs classified by colors and controlling the irradiation device to irradiate the most adequate light for the color of the stored foodstuffs, the effects of maintaining freshness of the foodstuffs and preventing chlorophyll degradation can be maximized.

Further, instead of the user directly selecting the light emitted from the irradiation device, since the user only inputs the information of the kind of the stored foodstuffs or the color recognition device automatically detects the color of the stored foodstuffs, the convenience in use is increased.

Also, because the light emitting elements are insertedly mounted in a refrigerator body, breakage of the light emitting elements due to the collision with the stored foodstuffs can be prevented.

Also, because the light emitted from the light emitting elements are irradiated through the polarized light filter or the concave lens, the light can be more evenly irradiated to the foodstuffs stored in the storage chamber.

The invention claimed is:

1. A refrigerator comprising:

a main body;

a storage chamber provided in the main body and includes a body;

a sliding-type vegetable box for storing food and coupled to the storage chamber; and an irradiation device that irradiates light within a visible light region into the vegetable box;

wherein the body comprises:

an insertion part configured to mount the irradiation device; and a light permeation member that seals the insertion part of the body.

2. The refrigerator according to claim 1, further comprising:

a reflection member mounted to the storage chamber to reflect the light emitted from the irradiation device.

3. The refrigerator according to claim 1, further comprising:

a transforming member that transforms the light emitted from the irradiation device into a side light type.

4. The refrigerator according to claim 2, wherein the storage chamber includes a vegetable compartment for storing vegetables.

5. The refrigerator according to claim 4, wherein the reflection member is mounted to the vegetable box.

6. The refrigerator according to claim 4, further comprising a transforming member that transforms the light emitted from the irradiation device into a side light, wherein the transforming member is an optical fiber.

7. The refrigerator according to claim 4, further comprising a transforming member that transforms the light emitted from the irradiation device into a side light, wherein the transforming member is formed correspondingly to a shape of an edge of the vegetable compartment.

8. The refrigerator according to claim 4, further comprising a transforming member that transforms the light emitted from the irradiation device into a side light, wherein the transforming member is mounted to an inner wall of the vegetable compartment.

9. The refrigerator according to claim 4, further comprising a transforming member that transforms the light emitted from the irradiation device into a side light, wherein the transforming member is formed correspondingly to a shape of the vegetable compartment in at least one direction of a depth direction and a width direction of the vegetable compartment.

10. The refrigerator according to claim 4, wherein the irradiation device includes a plurality of light sources for emitting the light in all directions.

11. The refrigerator according to claim 10, wherein the irradiation device is mounted to an inner wall of the vegetable compartment.

12. The refrigerator according to claim 11, wherein the irradiation device is protrudingly mounted to the inner wall of the vegetable compartment, and the vegetable box is formed with an opening at a position corresponding to the irradiation device.

13. The refrigerator according to claim 10, wherein the irradiation device is mounted in an inner wall of the vegetable compartment.

14. The refrigerator according to claim 4, wherein the irradiation device is protrudingly mounted to an inner wall of the vegetable compartment, and the vegetable box is formed with an opening at a position corresponding to the irradiation device.

15. The refrigerator according to claim 4, wherein the irradiation device is mounted in an inner wall of the vegetable compartment, and is formed with a scattering member that scatters the light emitted from the irradiation device.

16. The refrigerator according to claim 1, wherein the insertion part is provided with a reflection plate that reflects the light emitted from the irradiation device toward an inside of the body.

17. The refrigerator according to claim 16, wherein the reflection plate is formed with a plurality of convex portions.

18. The refrigerator according to claim 16, wherein the reflection plate is formed in a semispherical shape, and has an opening that opposes the storage chamber.

19. The refrigerator according to claim 1, wherein the light permeation member is a polarized light filter.

20. The refrigerator according to claim 1, wherein the light permeation member is a concave lens.

21. The refrigerator according to claim 1, wherein the light permeation member is provided with a sealing member at a side surface thereof.

22. The refrigerator according to claim 1, wherein the irradiation device irradiates the light of different combinations of wavelengths correspondingly to a kind of the foodstuffs stored in the storage chamber.

23. The refrigerator according to claim 22, wherein the irradiation device is disposed at an outer rear portion of the storage chamber.

24. The refrigerator according to claim 22, wherein the irradiation device included a protective cover having a surface, wherein the surface is corrosion treated.

25. The refrigerator according to claim 24, wherein the storage chamber and the protective cover are made of light permeable material.

26. The refrigerator according to claim 22, further comprising:

a selecting device that has a function of enabling a user to input information of a kind of the foodstuffs stored in the storage chamber, and changing a wavelength of the light emitted from the irradiation device, corresponding to a color of the foodstuffs.

27. The refrigerator according to claim 22, further comprising:

a color recognition device that recognizes a color of the foodstuffs stored in the storage chamber, and changes a wavelength of the light emitted from the irradiation device, corresponding to the color of the foodstuffs.

28. The refrigerator according to claim 22, wherein the irradiation device includes a plurality of light emitting diodes that emit the light having different wavelengths.

29. The refrigerator according to claim 22, wherein the storage chamber is configured to selectively store meats and vegetables.

30. The refrigerator according to claim 22, wherein the irradiation device is configured to irradiate red light to the foodstuffs when the color of the foodstuffs is red.

31. The refrigerator according to claim 22, wherein the irradiation device is configured to irradiate green light to the foodstuffs when the color of the foodstuffs is green.

32. The refrigerator according to claim 31, wherein the irradiation device is configured to further irradiate white light.

33. The refrigerator according to claim 22, wherein the irradiation device is configured to irradiate green-white combined light when vegetables are stored in the storage chamber.

34. The refrigerator according to claim 22, wherein the irradiation device is configured to irradiate red-blue combined light when meats are stored in the storage chamber.

35. The refrigerator according to claim 22, wherein the refrigerator is configured to adjust an inner temperature of the storage chamber, corresponding to the kind of the foodstuffs stored in the storage chamber, and wherein the temperature adjustment is performed in cooperation with the change of the combination of the light emitted from the irradiation device.

36. A refrigerator comprising:

a main body;

a storage chamber provided in the main body to store foodstuffs and includes a body; and a sliding-type vegetable box for storing food and coupled to the storage chamber;

an irradiation device that irradiates light within a visible light region into the storage box wherein the body comprises:

an insertion part configured to mount the irradiation device; and a light permeation member mounted at the insertion part of the body, and wherein the vegetable box comprises a scattering member that scatters the light emitted from the irradiation device.

37. The refrigerator according to claim 36, wherein the vegetable box further comprises a reflection plate that reflects the light irradiated into the vegetable box.

* * * * *